US011164734B2

(12) United States Patent
Williams et al.

(10) Patent No.: US 11,164,734 B2
(45) Date of Patent: Nov. 2, 2021

(54) LASER DESORPTION, ABLATION, AND IONIZATION SYSTEM FOR MASS SPECTROMETRY ANALYSIS OF SAMPLES INCLUDING ORGANIC AND INORGANIC MATERIALS

(71) Applicant: Exum Instruments, Wheat Ridge, CO (US)

(72) Inventors: Jeffrey Williams, Wheat Ridge, CO (US); Stephen Strickland, Wheat Ridge, CO (US); Neal Wostbrock, Albuquerque, NM (US); Oleg Maltsev, Albuquerque, NM (US); Matthew McGoogan, Denver, CO (US); Scott Messina, Brooklyn, NY (US)

(73) Assignee: Exum Instruments, Wheat Ridge, CO (US)

( * ) Notice: Subject to any disclaimer, the term of this patent is extended or adjusted under 35 U.S.C. 154(b) by 12 days.

(21) Appl. No.: 16/382,007

(22) Filed: Apr. 11, 2019

(65) Prior Publication Data

US 2020/0328072 A1 Oct. 15, 2020

(51) Int. Cl.

| | |
|---|---|
| ***H01J 49/16*** | (2006.01) |
| ***H01J 49/14*** | (2006.01) |
| ***H01J 49/04*** | (2006.01) |

(52) U.S. Cl.

CPC ..... *H01J 49/0463* (2013.01); *H01J 49/0418* (2013.01); *H01J 49/14* (2013.01); *H01J 49/164* (2013.01)

(58) Field of Classification Search

None

See application file for complete search history.

(56) References Cited

U.S. PATENT DOCUMENTS

| | | | | |
|---|---|---|---|---|
| 4,733,073 | A | 3/1988 | Becker et al. | |
| 4,988,879 | A * | 1/1991 | Zare | H01J 27/24 250/282 |
| 5,146,088 | A | 9/1992 | Kingham et al. | |

(Continued)

OTHER PUBLICATIONS

Spengler et al., "Postionization of Laser-Desorbed Organic and Inorganic Compounds in a Time of flight Mass Spectrometer", Analytical Instrumentation (Year: 1988).*

(Continued)

*Primary Examiner* — Michael J Logie

(74) *Attorney, Agent, or Firm* — Polsinelli PC; Gregory P. Durbin

(57) ABSTRACT

Systems and methods for sample analysis include applying, using a first laser source, a first beam to a sample to desorb organic material from a location of the sample and ionizing the desorbed organic material using a second laser source to generate ionized organic material. The ionized organic material is then analyzed using a mass spectrometer. A second beam from the first laser is then applied to the sample to ablate inorganic material from the location of the sample. The ablated inorganic material is then ionized using the second laser source to generate ionized inorganic material. The mass spectrometer is then used to analyze the ionized inorganic material. During analysis, one or more images of the sample may also be captured and linked to the collected analysis data.

10 Claims, 11 Drawing Sheets

(56) References Cited

U.S. PATENT DOCUMENTS

| | | | | |
|---|---|---|---|---|
| 2003/0111600 | A1* | 6/2003 | Thomson | H01J 49/0463 250/288 |
| 2005/0035284 | A1 | 2/2005 | Schultz et al. | |
| 2006/0097143 | A1* | 5/2006 | Franzen | H01J 49/145 250/282 |
| 2010/0200742 | A1* | 8/2010 | Schultz | G01N 27/622 250/252.1 |
| 2015/0357173 | A1 | 12/2015 | Koeppen et al. | |
| 2016/0005578 | A1* | 1/2016 | Koeppen | H01J 49/0031 250/282 |
| 2018/0174815 | A1* | 6/2018 | Bossmeyer | H01J 49/0059 |
| 2018/0190478 | A1* | 7/2018 | Cheung | H01J 49/107 |
| 2020/0015717 | A1* | 1/2020 | Taghioskoui | A61B 5/1473 |

OTHER PUBLICATIONS

Savina et al., "Microscopic Chemical Imaging with Laser Desorption Mass Spectrometry", Anal. Chem. (Year: 1997).*

Guo et al., "Infrared laser desorption/vacuum ultraviolet photoionization mass spectrometry of petroleum saturates: a new experimental approach for the analysis of heavy oils", Rapid Communications in mass spectrometry (Year: 2008).*

Carre et al., "potential of laser ablation and laser desorption mass spectrometry to characterize organic and inorganic environmental pollutants on dust particles", Rapid Commun. Mass Spectrom. 2005 (Year: 2005).*

International Searching Authority, International Search Report and Written Opinion, issued for International Application No. PCT/US2020/027747, dated Jul. 6, 2020 (9 pages).

Becker, C. H. & Gillen, K. T., Surface analysis by nonresonant multiphoton ionization of desorbed or sputtered species, Analytical Chemistry, 56:1671-1674 (1984).

Becker, C. H. & Gillen, K. T., Can nonresonant multiphoton ionization be ultrasensitive?, Journal of the Optical Society of America, B2:1438 (1985).

Kinsel, G. R. & Russell, D. H., Design and calibration of an electrostatic energy analyzer-time-of-flight mass spectrometer for measurement of laser-desorbed ion kinetic energies, Journal of the American Society for Mass Spectrometry, 6:619-626 (1995).

Getty, S. A., Brinckerhoff, W. B., Cornish, T., Ecelberger, S. & Floyd, M., Compact two-step laser time-of-flight mass spectrometer for in situ analyses of aromatic organics on planetary missions, Rapid Communications in Mass Spectrometry, 26:2786-2790 (2012).

Hurtado, P., Gámez F. & Martínez-Haya B., One- and Two-Step Ultraviolet and Infrared Laser Desorption Ionization Mass Spectrometry of Asphaltenes, Energy & Fuels, 24:6067-6073 (2010).

Yin, Z., Cheng, X., Liu, R., Hang, W. & Huang, B., Depth profiling of nanometer thin layers by laser desorption and laser postionization time-of-flight mass spectrometry, Journal of Analytical Atomic Spectrometry, 32:1878-1884 (2017).

Sabbah, H., Pomerantz, A. E., Wagner, M., Müllen, K. & Zare, R. N., Laser Desorption Single-Photon Ionization of Asphaltenes: Mass Range, Compound Sensitivity, and Matrix Effects, Energy & Fuels, 26:3521-3526 (2012).

Hahn, J. H., Zenobi, R. & Zare, R. N., Subfemtomole quantitation of molecular adsorbates by two-step laser mass spectrometry, Journal of the American Chemical Society, 109:2842-2843 (1987).

Vaeck, L. V. & Gijbels, R., Laser microprobe mass spectrometry: potential and limitations for inorganic and organic micro-analysis, Fresenius Journal of Analytical Chemistry, 337:743-754 (1990).

Schueler, B. & Odom, R. W., Nonresonant multiphoton ionization of the neutrals ablated in laser microprobe mass spectrometry analysis of GaAs and Hg 0.78Cd0.22Te, Journal of Applied Physics, 61:4652-4661 (1987).

Becker, C. H. et al., Surface analysis by nonresonant multiphoton ionization of desorbed or sputtered species, Analytical Chemistry, 56:1671-1674, 1984 (4 pages).

Becker, C. H. et al., Can nonresonant multiphoton ionization be ultrasensitive?, Journal of the Optical Society of America B, 2(9): 1438-1443, 1985 (6 pages).

Kinsel, G. R. et al., Design and calibration of an electrostatic energy analyzer-time-of-flight mass spectrometer for measurement of laser-desorbed ion kinetic energies, Journal of the American Society for Mass Spectrometry, 6:619-626, 1995 (8 pages).

Getty, S. A. et al., Compact two-step laser time-of-flight mass spectrometer for in situ analyses of aromatic organics on planetary missions, Rapid Communications in Mass Spectrometry, 26:2786-2790, Aug. 25, 2012 (5 pages).

Hurtado, P. et al., One- and Two-Step Ultraviolet and Infrared Laser Desorption Ionization Mass Spectrometry of Asphaltenes, Energy & Fuels, 24:6067-6073, Oct. 14, 2010 (7 pages).

Yin, Z. et al., Depth profiling of nanometer thin layers by laser desorption and laser postionization time-of-flight mass spectrometry, Journal of Analytical Atomic Spectrometry, 32:1878-1884, Aug. 8, 2017 (7 pages).

Sabbah, H. et al., Laser Desorption Single-Photon Ionization of Asphaltenes: Mass Range, Compound Sensitivity, and Matrix Effects, American Chemical Society, Energy & Fuels 26:3521-3526, 2012 (6 pages).

Hahn, J. H. et al., Subfemtomole quantitation of molecular adsorbates by two-step laser mass spectrometry, Journal of the American Chemical Society, 109:2842-2843, 1987 (2 pages).

Vaeck, L. V. &et al., Laser microprobe mass spectrometry: potential and limitations for inorganic and organic micro-analysis, Part I: Technique and Inorganic Applications, Fresenius Journal of Analytical Chemistry, 337:743-754, 1990 (12 pages).

Vaeck, L. V. &et al., Laser microprobe mass spectrometry: potential and limitations for inorganic and organic micro-analysis, Part II: Organic Applications, Fresenius Journal of Analytical Chemistry, 337:755-765, 1990 (11 pages).

Schueler, B. et al., Nonresonant multiphoton ionization of the neutrals ablated in laser microprobe mass spectrometry analysis of GaAs and Hg0.78Cd0.22Te, Journal of Applied Physics, 61(9):4652-4661, 1987 (12 pages).

* cited by examiner

LASER DESORPTION, ABLATION, AND IONIZATION SYSTEM FOR MASS SPECTROMETRY ANALYSIS OF SAMPLES INCLUDING ORGANIC AND INORGANIC MATERIALS

TECHNICAL FIELD

Aspects of the present disclosure involve systems and methods for chemical analysis of samples. More specifically, the present disclosure is directed to systems and methods for analyzing organic and inorganic components of a sample

BACKGROUND

Mass spectrometry is a technique for analyzing chemical species of a sample material by sorting ions of the material based on their mass-to-charge ratio. In general, the process includes generating ions from a sample such as by bombarding the sample with an energy beam (e.g., a photon or electron beam) in the case of solid sample analysis. The resulting ions are then accelerated and subjected to an electromagnetic field resulting in varying deflection of the ions based on their respective mass-to-charge ratios. A detector (e.g., electron multiplier) is then used to detect and quantify particles having the same mass-to-charge ratios. The results of such analysis are generally presented as a spectrum indicating the relative amount of detected ions having the same mass-to-charge ratio. By correlating the masses of the ions obtained during analysis with known masses for atoms and molecules, the specific atom or molecule for each component of the spectra may be identified, quantified, and the general composition of the sample can be obtained.

Conventional mass spectrometry systems are complex and costly instruments that generally require significant capital investment, space, and training to operate. Moreover, many such systems are limited in their ability to effectively analyze both organic and inorganic components of a given sample.

With these thoughts in mind among others, aspects of the analysis systems and methods disclosed herein were conceived.

SUMMARY

In one aspect of the present disclosure a method of sample analysis is provided. The method includes applying, using a first laser source, a first beam to a sample to desorb organic material from a location of the sample and ionizing the desorbed organic material using a second laser source to generate ionized organic material. The method further includes analyzing the ionized organic material using a mass spectrometer. The method also includes applying, using the first laser, a second beam to the sample to ablate inorganic material from the location of the sample, ionizing the ablated inorganic material using the second laser source to generate ionized inorganic material, and analyzing the ionized inorganic material to the mass spectrometer.

In one implementation of the method, the first beam has a first wavelength that is a fundamental wavelength of the first laser source and the second beam has a second wavelength less than the fundamental wavelength of the first laser source. The second beam may be generated by each of filtering and focusing a beam from the first laser having the fundamental wavelength of the laser.

Characteristics of the first and second beam may vary. For example, in certain implementations, the first beam has a wavelength of approximately 1064 nm. In another implementation, the second beam has a wavelength of approximately 266 nm. In still another implementation, each of the first beam and the second beam each have a beam width of 50 μm or less at the location of the sample.

The energy density of the beams may also vary. For example, in one implementation, during the desorption process, the first beam has an energy density of at least 10 MW/cm2 at the location of the sample. In another implementation, during ablation, the second beam has an energy density of at least about 1 GW/cm$^2$ at the location of the sample.

In certain implementations, ablating the sample generates a plasma cloud and the method further includes waiting between ablating the sample and ionizing the ablated inorganic material such that the plasma cloud extinguishes.

In another implementation, the method further includes, prior to applying the first beam, capturing an image of the location of the sample.

In another aspect of the present disclosure, a system for performing sample analysis is provided. The system includes a vacuum chamber and a sample holder disposed within the vacuum chamber for retaining a sample. The system further includes a first laser system for producing each of a desorption beam for generating a vapor cloud of organic material from the sample and an ablation beam for generating a particle cloud from the sample. Each of the desorption beam and the ablation beam are provided by a first laser source of the first laser system. The system also includes a second laser system for producing an ionization beam, the ionization beam adapted to ionize each of the vapor cloud and the particle cloud to produce ionized organic material and ionized inorganic material, respectively. The system further includes a mass spectrometer in communication with the vacuum chamber and configured to analyze each of the ionized organic material and the ionized inorganic material.

In one implementation, the first laser source is configured to produce a laser having a first wavelength, the first wavelength being a wavelength of the desorption beam. In such implementations, the first laser system may further include a filter element configured to change the first wavelength to a second wavelength, the second wavelength being a wavelength of the ablation beam. For example, in at least one implementation, the first laser source is a neodymium-doped yttrium aluminum garnet (Nd:YAG), the first wavelength is approximately 1064 nm, and the second wavelength is approximately 266 nm.

In another implementation, the ionization beam has a wavelength of approximately 1064 nm. In such implementations, the ionization beam may be directed perpendicular to a normal of a surface of the sample and may have an energy density at a location of intersection with the normal of at least about 1 GW/cm$^2$.

In still another implementation, the sample holder includes a kinematic mount.

In another implementation, the first laser system further includes optical elements adapted to manipulate each of the desorption beam and the ablation beam such that each of the desorption beam and the ablation beam have a beam width of approximately 50 μm at a surface of the sample. In such implementations, the optical elements may further manipulate the desorption beam to have an energy density of at least about 10 MW/cm$^2$ at the surface of the sample and the ablation beam to have an energy density of at least about 1 $GW/cm^2$ at the surface of the sample.

In certain implementations, the system may further include a camera system coupled to the vacuum chamber, wherein the first laser system is configured to direct each of the desorption beam and the ablation beam to a location on a surface of the sample and the camera system is adapted to capture images of the location on the surface of the sample.

BRIEF DESCRIPTION OF THE DRAWINGS

Example embodiments are illustrated in referenced figures of the drawings. It is intended that the embodiments and figures disclosed herein are to be considered illustrative rather than limiting.

FIG. 5A illustrates initial preparation of the sample and analysis system, FIG. 5B illustrates general operation of the analysis system, FIG. 5C illustrates the steps involved in analyzing each of organic and inorganic components of a sample, and FIG. 5D illustrates quantification of the analysis and feedback to improve operation of the analysis system.

DETAILED DESCRIPTION

Figure 1A:
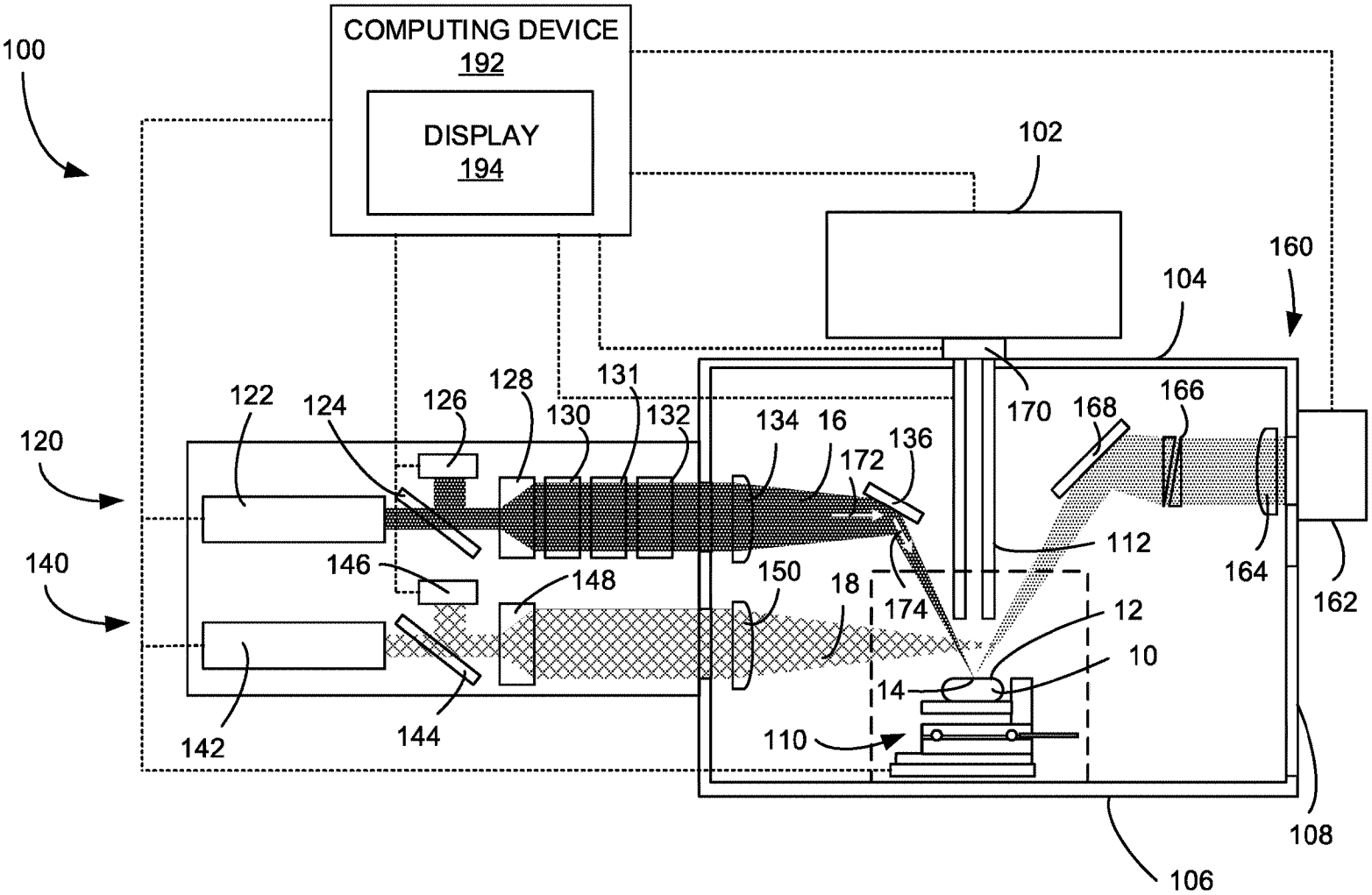
FIG. 1A is a schematic illustration of an analysis system according to an implementation of the present disclosure.

Aspects of the present disclosure involve systems and methods for analyzing a sample using mass spectrometry and, in particular, for efficiently analyzing both organic and inorganic components of the sample. Analysis systems according to the present disclosure implement an extraction and ionization technique in which both organic and inorganic material are extracted from a sample, ionized, and analyzed. More specifically, in a first stage of the analysis process, organic material is desorbed from a location of a sample is desorbed to form a vapor. The vapor is then ionized and the resulting ions are transported to a mass spectrometer for analysis. In a second stage of the analysis process, non-organic material is ablated from the sample, forming a particle cloud. The particle cloud is then ionized and the resulting ions are transported to the mass spectrometer for analysis.

To facilitate the foregoing processes, systems according to the present disclosure include a single laser source and various optical elements to produce beams suitable for each of desorption and ablation. For example, in one implementation, the system includes a neodymium-doped yttrium aluminum garnet (Nd:YAG) used to produce each of a relatively low energy beam (e.g., in the infrared (IR) range) for heating and desorbing organic material from the sample and a relatively high energy beam (e.g., in the ultraviolet (UV) range) beam capable of ablating inorganic material from the sample.

Each of the desorbed organic material and the ablated inorganic material are subsequently ionized using a second laser source. In one implementation, the second laser source is configured to produce a relatively high energy beam (e.g., in the UV range) and is directed to intersect the vapor and particle cloud produced by the desorption and ablation processes, respectively. The resulting ions are then extracted and transported (e.g., by applying an electrostatic potential using an electrostatic lens system such as an Einzel lens, quadrupole ion guide, or ion funnel) as an ion beam into a mass spectrometer. Mass spectrometry data is then collected and quantified.

Conventional techniques, such as laser-induced breakdown spectroscopy (LIBS) and laser ionization mass spectroscopy (LIMS), which only use plasma generated by an initial ablation laser, have fundamental weaknesses centered around low ionization efficiency and matrix effects (i.e., the effects on the analysis caused by components of the sample other than the specific component to be quantified). These shortcomings lead to difficulty with quantification and have contributed to the difficulty in fully commercializing such technologies across multiple fields and applications. For example, reasonable quantification of LIBS data requires sample standard matching and, therefore, is highly subject to matrix effects. Therefore, LIBS has been difficult to use in applications in which a variety of matrices may be used and requires a significant amount of data reduction.

In contrast, the techniques described herein have the advantage of ionizing from the neutral particle cloud resulting from ablation. This cloud is significantly less variable across different matrices and more closely represents the sample constituents and their proportions within the sample. Accordingly, the techniques described herein have significant potential to quantify multi-matrix samples using uniform or algorithmically adjusted quantification schema.

Implementations of the present disclosure may further include camera systems for capturing images of samples prior to and during the analysis process. For example, the analysis system may include a camera system configured to capture a detailed image of the specific location of the sample being desorbed/ablated. Such images may be associated with any captured data, allowing users to visually analyze a sample at a macro level, visually identify particular regions of interest of the sample, readily obtain detailed data for such regions, and perform various other functions.

In addition to the foregoing, various other advantages are associated with implementations of the present disclosure. For example, the implementations of the present disclosure may be static systems. Such systems may operate using a vacuum chamber within which no gases are required since ionization does not require an inductively coupled plasma source. Doing so eliminates molecular isobars that may hinder detection of elements such as, but not limited to, silicon, potassium, calcium, and iron. Moreover, the two-step multiphoton ionization source allows for an algorithmic approach to quantification. The absence of hot, inductively coupled plasma also eliminates the thermal emission of contaminant ions from the cones and injector that may hinder the analysis of sodium, lead, and many volatile metals. Rather, in implementations of the present disclosure, ions are sourced only from the sample spot under ablation.

Implementations of the present disclosure also have considerable advantage regarding the transmission efficiency of the generated ion beam. For example, laser ablation inductively coupled plasma mass spectrometry (LA-ICP-MS) has a high ionization efficiency (≥90%) for elements with a first ionization potential of approximately 8 eV or less and has a relatively low transmission efficiency of about 0.01-0.001% (i.e., approximately 1 in every $10^5$-$10^6$ ions reach the detector). This is largely due to the fact the ions are created in atmosphere (argon plasma) and are then transferred to the mass spectrometer in stages until reaching the ultimate high-vacuum mass filter. The transition through these stages is done through a system of cones and lenses that removes a significant portion of ions. In contrast, the techniques discussed herein do not suffer from transmission losses across atmosphere to vacuum systems as the entirety of the process is conducted under vacuum.

Another advantage of the presently disclosed system is the ability to efficiently analyze both organic and inorganic matter. Organic analysis is performed in at least certain implementations of the present disclosure using an infrared component of the Nd:YAG laser (1064 nm). A long-pass cut-on filter (or similar filtering element) may then be placed in the beam path allowing for the transmission of IR energy while blocking UV energy. The IR pulse may then be used to flash heat the sample. By flash heating (e.g., on the order of $10^8$ K/s), the organic compounds are desorbed from the sample surface intact where lower heating rates may result in undesirable decomposition of the organic material.

Other advantages of implementations of the present disclosure relate to their overall size, efficiency, and cost-effectiveness as compared to conventional analysis systems. For example, by using laser sources for multiple purposes (e.g., desorption and ablation, multi-energy level ionization) and making specific use of optics to redirect beams from such laser sources, the overall size and shape of the analysis system may be reduced. As a result, implementations of the present disclosure are generally suitable for benchtop and/or field applications that would otherwise be problematic for conventional systems.

These and other features and advantages of systems according to the present disclosure are provided below.

Analysis System Components and Design

FIG. 1A is a schematic illustration of an analysis system 100 in accordance with the present disclosure. In general, the analysis system 100 includes a sample chamber 104 within which a sample 10 is disposed for analysis by a mass spectrometer 102. The analysis system 100 is capable of operating in multiple modes to facilitate analysis of both organic and inorganic material of the sample 10. Generally and as described below in further detail, the analysis system 100 includes a desorption/ablation (D/A) sub-system 120 to selectively apply energy to desorb organic material from the sample 10 or to ablate inorganic material from the sample 10. The desorbed or ablated material is then ionized using an ionization sub-system 140. The ionized material is then directed to a mass spectrometer 102 for analysis. In certain implementations, the mass spectrometer 102 is a time-of-flight (ToF) mass spectrometer.

The analysis system 100 further includes a computing device 192. The computing device 192 may take various forms, however, the computing device 192 generally includes one or more processors and a memory including instructions executable by the one or more processors to perform various functions of the analysis system 100. In one implementation, the computing device 192 may be physically integrated with the other components of the analysis system 100. For example, the computing device 192 may be a panel, tablet, or similar computing device integrated into a wall of the sample chamber 104. In other implementations, the computing device 192 may be a separate device operably coupled to the other components of the analysis system 100. Coupling between the computing device 192 and the components of the analysis system 100 may be wireless, wired, or any combination and may use any suitable connection and communication protocol for exchanging data, control signals, and the like. To facilitate interaction with the analysis system 100, the computing device 192 may include various input and output devices including, but not limited to, a display 194 (which may be a touchscreen); a microphone; speakers; a keyboard; a mouse, trackball, or other pointer-type device; or any other suitable device for receiving input from or providing output to a user of the analysis system 100.

Figure 1B:
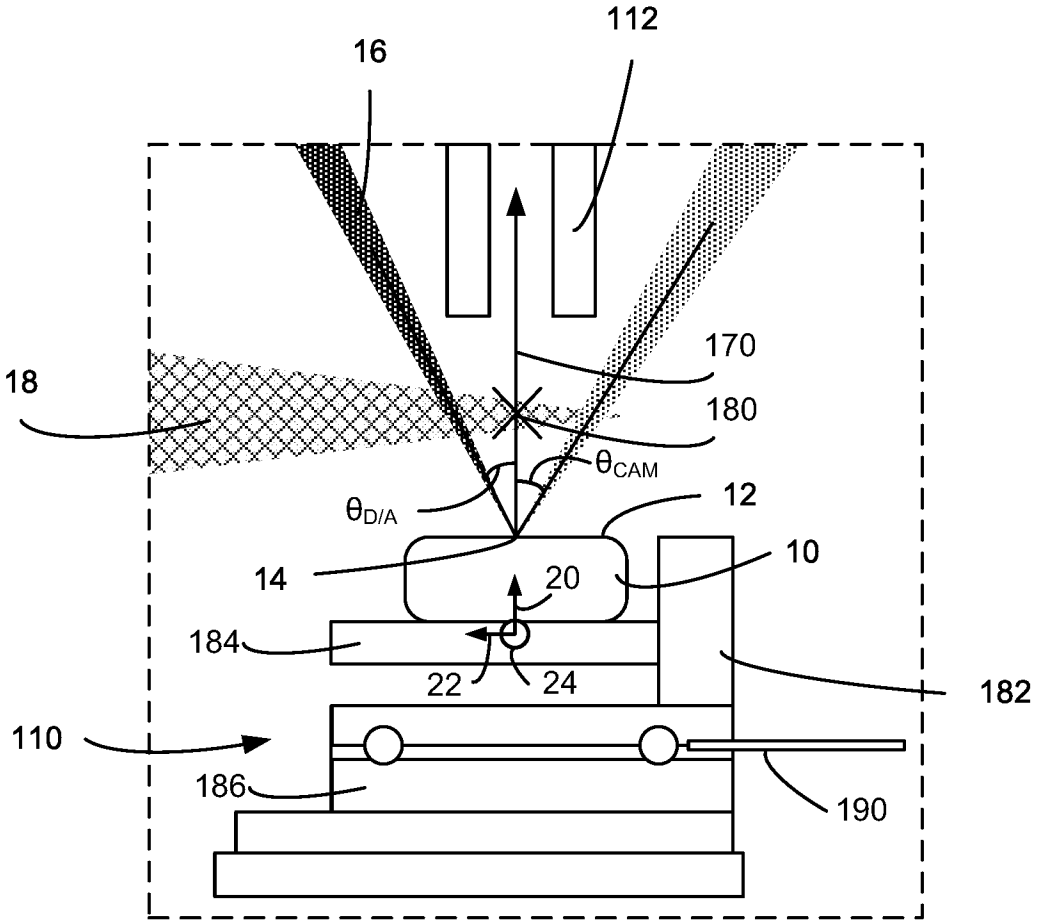
FIG. 1B is a detailed schematic illustration of a mounting assembly of the analysis system of FIG. 1A.

The sample chamber 104 generally includes a vacuum chamber 106 accessible by a chamber door 108 or similar sealable opening. During operation, the sample 10 is supported in a mount 110. In certain implementations, the mount 110 may be motorized or otherwise movable such that the sample 10 may be repositioned within the vacuum chamber 106. By doing so, analysis of the sample 10 may be conducted at multiple locations without removing the sample 10 from the vacuum chamber 106. As described in further detail below, the mount 110 may be configured to move incrementally and with a high degree of precision to facilitate mapping of the sample 10. FIG. 1B provides a more detailed view of the mount 110 and associated components of the analysis system 100.

The D/A sub-system 120 is generally configured to provide energy beams of at least two distinct wavelengths to a surface 12 of the sample 10. To do so, the D/A sub-system 120 includes a D/A laser source 122 and optical elements configured to generate the different beams. The first wavelength beam is generally used to heat the sample 10 and desorb organic material from the sample 10 without substantially decomposing the organic material or damaging the surface 12 of the sample 10. The organic vapor produced by the desorption process is then energized by the ionization sub-system 140 and the resulting ionized vapor is directed to the mass spectrometer 102 for analysis, such as by a quadrupole ion guide 112 (or similar guide device, such as, but not limited to an Einzel lens or a series of lenses). The second wavelength beam has a higher energy density than the first wavelength beam and is used to ablate inorganic material from the surface 12 of the sample 10. Similar to the organic vapor produced by desorption, the particle cloud produced by ablation is ionized by the ionization sub-system 140. In certain implementations, such ionization may occur after a delay to allow plasma generated during the ablation process to extinguish. The resulting ionized particle cloud is then directed to the mass spectrometer 102 for analysis by the quadrupole ion guide 112 (or similar guide device). In certain implementations, a gate valve 170 or similar mechanism may be disposed between the ion guide 112 and the mass spectrometer 102, for example and among other things, to reduce pump down time between samples, to keep the mass spectrometer 102 under high vacuum conditions, and to reduce exposure to air.

The optical elements of the D/A sub-system 120 are generally used to direct a beam (such as beam 16, which may be either a desorption or ablation beam) to a sampling location 14 of the sample 10 and to control each of the wavelength of the beam 16 and an energy density of the beam 16 at the sampling location 14. Direction of the beam 16 may be achieved, for example, by one or more mirrors disposed within the vacuum chamber 106, such as mirror 136, positioned to direct the beam 16 from an initial beam direction 172 to an incident beam direction 174 having a particular angle of incidence ($\theta_{D/A}$, shown in FIG. 1B) relative to a normal 170 defined by a surface 12 of the sample 10. The value of $\theta_{D/A}$ may vary based on the location of the optical elements of the D/A sub-system 120, the location of the D/A laser source 122 relative to the surface 12 of the sample 10, and the general size and shape of the vacuum chamber 106. However, in at least some implementations of the present disclosure, $\theta_{D/A}$ is from and including about 15 degrees to and including about 45 degrees. In one specific implementation, $\theta_{D/A}$ is about 40 degrees. Among other things, such values for $\theta_{D/A}$ allow for a relatively small form factor for the analysis system 100 (e.g., by avoiding interference of the mirror 136 and other optical components with the ion guide 112) while ensuring that sufficient energy is delivered to the surface 12 of the sample 10 to desorb/ablate.

In addition to redirection of the beam 16 produced by the D/A laser source 122, optical elements of the D/A sub-system 120 may also control the beam 16 by, among other things, modifying the wavelength of the beam 16, attenuating the beam 16, focusing/diffusing the beam 16, and splitting the beam 16. As a first example, the D/A sub-system 122 may include at least one filter 130 that may be configured to change the wavelength of a beam generated by D/A laser source 122 from a fundamental wavelength of the D/A laser source 122 to a harmonic wavelength. In other implementations, the filter 130 may include multiple selectable filter elements configured to change the wavelength from the fundamental wavelength of the D/A laser source 122 to one of several harmonic wavelengths. In either case and in at least certain implementations, the filter 130 may be in the form of an electronically controlled filter wheel that allows automatic or manual application or removal of one or more filters to the beam 16 produced by the D/A laser source 122.

The D/A laser source 122 may include various types of laser sources, however, to facilitate a relatively compact form factor, in at least certain implementations of the present disclosure the D/A laser source 122 includes a miniaturized, high-powered, solid-state laser. For example and without limitation, the D/A laser source 122 may be a neodymium-doped yttrium aluminum garnet (Nd:YAG) laser. In one specific example, the Nd:YAG laser may have a fundamental wavelength of 1064 nm, i.e., within the infrared (IR) range. In such implementations, the fundamental 1064 nm beam may be used for desorbing organic matter from the sample 10. When ablation is to occur, a filter may be applied to the 1064 nm beam such that the resulting beam has a wavelength of 266 nm (e.g., the fourth harmonic wavelength of the original 1064 nm beam), falling in the ultraviolet (UV) range. This higher energy beam may then be used to ablate the sample 10 at the sampling location 14 for analysis of inorganic matter.

In each of the desorption and ablation cases, the beam may also be attenuated, expanded, or focused to modify the power density at the sample 10. Accordingly, the D/A sub-system 120 may further include one or more of a beam expander 128, one or more attenuators (e.g., UV attenuator 131 and IR attenuator 132), and a focusing lens 134. The D/A sub-system 120 may also include multiple beam expanders, attenuators, focusing lenses, or similar optical elements, as required by the particular application. Beam expanders used in implementations of the present disclosure may be fixed or variable and attenuators may be included for attenuating beams having specific wavelengths or ranges of wavelengths. For example, as previously discussed, in at least one implementation, the D/A laser source 122 (and other optical elements) may generate a beam in either the IR or UV range for desorption and ablation, respectively. In such implementations, one or both of an IR attenuator and a UV attenuator may be included in the D/A sub-system 120 to further tune the energy of the beam produced by the D/A sub-system 120. Finally, the focusing lens 134 may be configured to focus the beam to have a particular size and, as a result, particular energy density at the surface 12 of the sample 10.

As previously discussed, in at least one example the D/A laser source 122 is a Nd:YAG laser capable of producing a desorption beam with a fundamental wavelength of 1064 nm. The optics of the D/A sub-system 120 may be configured such that the beam width and/or energy density of the desorption beam is sufficient and suitable for thermal desorption of organics of various molecular sizes without causing decomposition. For example, when operating in a desorption mode, the D/A sub-system 120 generates a desorption beam with a wavelength of 1064 nm and an energy density at the surface 12 of the sample 10 from and including about 10 $MW/cm^2$ to and including about 150 $MW/cm^2$. In certain implementations, the optics of the D/A sub-system 120 may also be configured to focus the desorption beam to be no more than about 50 μm in diameter at the surface 12 of the sample 10. As discussed below in further detail, doing so allows multiple samples to be taken from the sample 10 at a relatively high sample density to facilitate thorough analysis of the sample 10.

With respect to ablation and as previously noted, the 1064 nm beam of the Nd:YAG laser may be filtered to produce an ablation beam having a wavelength of 266 nm. The optics of the D/A sub-system 120 may be configured such that the beam width and/or energy density of the ablation beam is sufficient and suitable for breaking bonds of non-organic matter of the sample. For example, in at least one implementation, when operating in an ablation mode, the D/A sub-system 120 generates an ablation beam with a wavelength of 266 nm and an energy density at the surface 12 of the sample 10 from and including about 1 $GW/cm^2$ to and including about 100 $GW/cm^2$. Again, the optics of the D/A sub-system 120 may also be configured to focus the ablation beam to be no more than about 50 μm in diameter at the surface 12 of the sample 10.

Although 50 μm is provided above as an example diameter of the desorption and ablation beams as the surface 12 of the sample 10, it should be appreciated that the diameter of the beam may vary between implementations of the present disclosure and may also be variable within a given implementation. For example, any suitable number of fixed or variable beam expanders and/or focusing lenses (such as the beam expander 128 and the focusing lens 134) may be implemented in the D/A sub-system 120 to achieve various beam widths and, as a result various energy densities of the beam at the sample 10.

As illustrated in FIG. 1A, the D/A sub-system 120 may further include at least one beam splitter 124 configured to split the beam of the D/A sub-system 120 and direct a portion of the beam to an energy meter 126. The energy meter 126 may be used to measure the energy of the beam. Such energy values may be used as a feedback or similar mechanism to facilitate control of the analysis system 100, as inputs to one or more equations or algorithms used to analyze the sample 10, or any other use related to the operation of the analysis system 10 or processing of data obtained by the analysis system 10.

To facilitate analysis of each of the desorbed organic material and ablated inorganic material, the analysis system 100 may include an ionization sub-system 140 configured to ionize the organic and inorganic material liberated from the sample 10 during the desorption and/or ablation processes. Similar to the D/A sub-system 120, the ionization sub-system 140 generally includes an ionization laser source 142 and various optical elements for manipulating an ionization beam generated by the ionization laser source 142.

In general, the ionization sub-system 140 provides a beam for exciting, at least in part, one or both of the vapor created by the desorption process and the particle cloud generated by the ablation process. In one specific implementation, the beam generated by the ionization sub-system 140 excites the vapor/particle cloud using multiphoton ionization (MPI). In general, MPI provides a relatively efficient method of generating ions (as compared to argon plasma of inductively coupled plasma processes) across a wide range of ionization energies. For example, the ionization sub-system 140 may implement MPI such that it is capable of generating ions having ionization potential of approximately 9.3 eV or less. MPI is further advantageous in that it is capable of ionizing a range of particles as opposed to other techniques, such as resonant enhanced multiphoton ionization (REMPI), which generally require tuning of the ionization beam to a particular ionization frequency to excite particular molecules or particles.

The vapor created by the desorption process and the particle cloud generated by the ablation process may rise substantially normal to the surface 12 of the sample 10. Accordingly, as illustrated in FIG. 1A, in at least some implementations of the present disclosure, the ionization sub-system 140 may be configured to direct the ionization beam parallel to the surface 12 of the sample 10 and, as a result, through any vapor/particle cloud produced from the sample 10.

Although various types of laser sources may be used for the ionization laser source 142, in at least one implementation, the ionization laser source 142 produces a beam having a wavelength of 266 nm. The ionization sub-system 140 may also be configured such that the beam produced by the ionization laser source 142 has a particular beam width and/or energy density at an ionization location disposed above the surface 12 of the sample 10. For example, in one implementation the beam may be focused at a particular location 180 above the sample 10 such that the beam has an energy density of at least about 1 $GW/cm^2$ at the location 180. To do so, the ionization sub-system 140 may include various optical elements including, without limitation, an attenuator 148, and a focusing lens 150. In other implementations filters and/or other optical elements also may be included in the ionization sub-system 140 for further control of the ionization beam.

In one specific example, the ionization sub-system 140 may include optics to control the intensity of the ionization beam depending on whether the analysis system 100 is performing analysis of organic or inorganic matter. In the case of the former, optical elements, such as filters and attenuators, may be used to reduce the energy of the ionization beam from a first energy level suitable for ionizing ablated inorganic material to a second energy level suitable for ionizing desorbed organic material. For example, the second energy level may be chosen to decrease or eliminate the likelihood of fragmentation effects that may be caused if the desorbed organic material were to be ionized using the same energy level as required during the ablation process.

Application of the ionization beam to the vapor/particle cloud may occur after a particular delay following the completion of desorption or ablation, respectively. In the case of ablation in particular, such a delay may be implemented to allow any plasma produced during the ablation process to extinguish. While the duration of the delay may vary between specific applications, in at least one implementation, the delay may be from an including about 10 ns up to and including about 1 μs between the completion of ablation and the application of the ionization laser to the resulting particle cloud.

As further illustrated in FIG. 1A, the analysis system 100 may also include a camera system 160 for capturing images of the sample 10 and, in particular, for capturing detailed images of specific portions of the sample subject to desorption and/or ablation. The camera system generally includes a camera 162 and may further include multiple optical elements for directing light reflected off the surface 12 of the sample 10 to the camera 162.

In certain implementations, the relatively tight constraints of within the vacuum chamber 106 and placement of the quadrupole ion guide 112 normal to the surface 12 of the sample 10 may require the camera 162 to be indirectly aligned with the surface 12 of the sample 10. Accordingly, the optical elements of the camera system 160 may be used to facilitate placement of the camera 162 at a suitable offset relative to the surface 12 while still enabling proper capture of a current desorption/ablation location of the surface 12. For example and without limitation, in at least one implementation, the camera system 160 may include an objective lens 164, one or more prisms (e.g., prism pair 166), and a mirror 168 in to achieve a relatively tight angle of incidence to the sample surface 12. In at least one implementation, the angle of incidence associated with the camera system 160 ($\theta_{CAM}$, shown in FIG. 1B) is at least approximately 24 degrees, which generally permits light to exit the vacuum chamber 106 to the camera 162 in a substantially parallel direction while still allowing capture of a high quality image by the camera 162.

As previously noted and with reference to FIG. 1B, the sample 10 may be retained within the vacuum chamber 106 on a mount 110. The mount 110 may be movable such that a sampling location 14 of the sample 10 may be varied. The mount 110 may be manually or automatically adjustable in multiple directions to ensure a predetermined size and location of the beam 16. For example, the mount 110 may be adjustable in along a first axis 20 (e.g., a z- or vertical axis) to ensure that the sampling location 14 is disposed at a particular height relative to the ion guide 112. The mount 110 may also be movable along each of a second axis 22 and a third axis 24 (e.g., an x-axis and y-axis or similar axes of a horizontal plane) to change the location of the sampling location 14 relative to the surface 12 of the sample 10.

In at least one implementation, the analysis system 100 may be configured to execute a sampling process in which successive samples are obtained from different locations of the sample 10. For example and as discussed below in further detail in the context of FIG. 4, the analysis system 100 may be configured to analyze a sample according to a grid pattern. For each element of the grid, the analysis system 100 may capture a detailed image using the camera system 160 and perform each of an organic and inorganic analysis by desorption and ablation, respectively. Between each analysis, the analysis system 100 may be configured to move the mount 110 such that the sampling location 14 is changed relative to the surface 10 of the sample 12. By automating such a process, a sample may be thoroughly analyzed while requiring only minimal intervention from an operator.

In certain implementations, the mount 104 may include a kinematic mount system. In general, a kinematic mount (or kinematic coupling) is a fixture designed to constrain a component in a particular location with high degrees of certainty, precision, and repeatability. Kinematic mountings generally include six contact points between a first part and a second part such that all degrees of freedom of the first part are constrained. Examples of kinematic mounts include, without limitation, Kelvin and Maxwell mounts. In a Maxwell mount, for example, three substantially V-shaped grooves of a mounting surface are oriented to a center of the part to be mounted, while the part being mounted has three corresponding curved surfaces (e.g., hemispherical or spherical surfaces) configured to sit down into the three grooves. The grooves may be cut into the mounting surface or formed by parallel rods (or similar structures) coupled to the mounting surface. When the curved surfaces are disposed in the grooves, each of the grooves provides two contact points for the respective curved surface, resulting in a total of six points of contact that fully constrain the part.

As illustrated in FIG. 1B, in implementations in which a kinematic mount is used, the mount 104 may include a sample holder 182 including a sample stage 184 and a kinematic base 186, the sample holder 182 being removable from the vacuum chamber 106. During use, the sample 10 is placed and retained on the sample stage 184 while the sample holder 182 is outside of the vacuum chamber 106. Once the sample 10 is coupled to the sample stage 184, the sample holder 184 is disposed within the vacuum chamber 106. More specifically, the kinematic base 186 of the sample holder 182 is received by and kinematically coupled to a kinematic mounting surface 188 disposed within the vacuum chamber 106. The mount 104 may further include a magnetic or other latch 190 to fix the kinematic base 186 to the kinematic mounting surface 188. The latch 190 may be integrated into either the sample holder 182 of the kinematic mounting surface 188.

In addition to repeatable placement of the sample 10 within the vacuum chamber 106, implementation of kinematic mounting may also facilitate the generation of composite images and composite image stacking. For purposes of the present disclosure, composite image stacking generally refers to the process of linking one or more low scale images of the sample 10 with multiple large scale images, each of which corresponds to a portion of the low scale image. For example, the small scale image may correspond to an overall image of the entire sample (or a relatively large portion of the sample 10, e.g., a quarter of the sample) while the large scale images may correspond to specific locations of the sample 10 at which organic/inorganic sampling and analysis is conducted.

Figure 2:
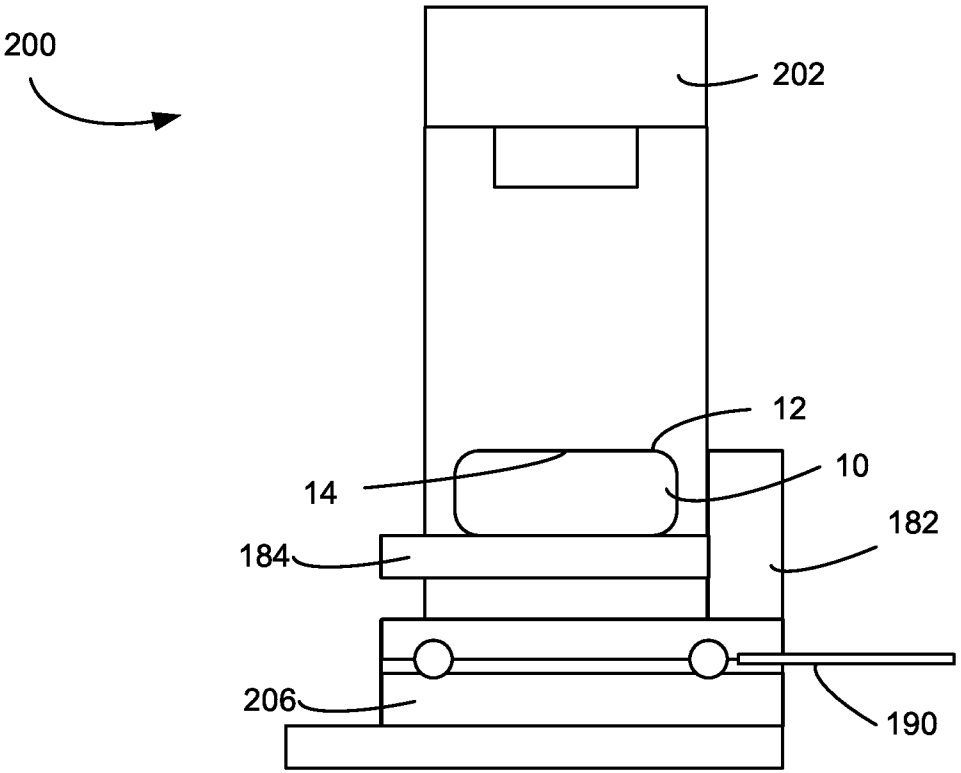
FIG. 2 is a schematic illustration of an image capture system for use in conjunction with the analysis system of FIG. 1A.

FIG. 2 is a schematic illustration of an image capture system 200 that may be used in conjunction with the analysis system 100 of FIG. 1A to facilitate composite image stacking and, in particular, to capture small scale/macro images of the sample 10 prior to analysis. In general, after a sample has been loaded into the sample holder 182, the sample holder 182 is placed onto a kinematic mounting surface 206 of the image capture system 200. A latch 190 may then be used to fix the sample holder 182 to the kinematic mounting surface 206. A camera 202 of the image capture system 200 is then used to capture one or more macro-scale images of the sample 10. Following capture of the one or more images, the sample holder 182 including the sample 10, is moved into the vacuum chamber 106 of the analysis system 100 for subsequent analysis.

The camera 202 is generally positioned at a known location relative to the sample holder 182 when the sample holder 182 is placed onto the kinematic mounting surface 206. For example, and without limitation, the camera 202 may be positioned directly above the center of the sample stage 184. Similarly, when placed within the vacuum chamber 106, the mount 104 may be "zeroed" such that the sample holder 182 is also disposed in a known position within the vacuum chamber 106. Due to the high repeatability of the kinematic mounting and the ability to place the sample holder 182 in a known position in both the analysis system 100 and image capture system 200, a common coordinate system (or mapping between different coordinate systems) may be readily ascertained between the image capture system 200 and analysis system 100. Based on the common coordinate system, large scale images captured during analysis (e.g., by the camera system 160) may be readily mapped to corresponding locations of the macro image(s) previously captured by using the image capture system 200.

In addition to establishing a relationship between the macro image and the large-scale/micro images, establishing the common coordinate system also facilitates control and operation of the analysis system 100. For example, in at least one implementation, once the macro-scale image has been captured, it may be displayed on the display 194 of the computing device 192. A user of the analysis system may then use an input (mouse, touchscreen, etc.) to identify one or more specific locations of interest, define or select a sampling pattern/path along which multiple samples are to be taken, or otherwise provide input as to where and how the sample should be analyzed. As described below in further details, the analysis system 100 may generally, for each location, capture one or more detailed images as well as analysis data for both organic and inorganic material at the location. The detailed images and analysis data may then be linked to the corresponding location of the macro image such that a user may select locations of the sample in the macro image and "drill-down" to view one or both of the detailed image and the analysis data for the selected location.

By implementing the foregoing approach, the macro-level image may be readily aligned with any detailed images of specific sample locations (e.g., obtained using the camera system 160 of the analysis system 100). As discussed below, the detailed images may then be linked or otherwise associated with any data resulting from organic and/or inorganic analysis conducted at the location represented by the detailed image. In other words, the various images captured during analysis of a given sample may be used to generate a stacked and zoomable image that is also tied to underlying analysis data. So, for example, a user may be able to view the macro-level image of a given sample and toggle display of one or more heat maps (or similar visualizations) indicating the presence or concentration of different chemical components identified during analysis. The user may also be able to select specific locations to obtain more detailed information about the chemical makeup and analysis results for that location.

Figure 3B:
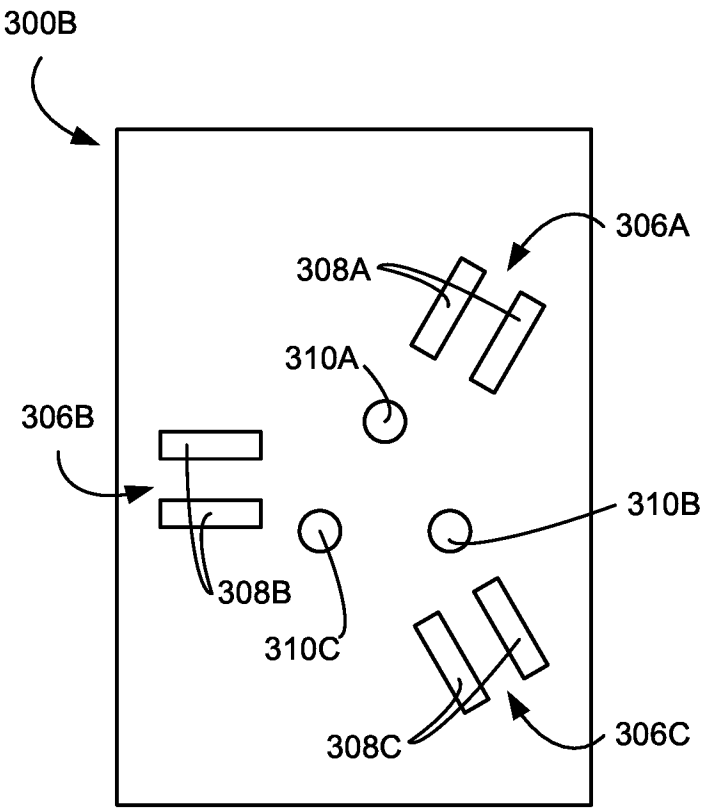
FIGS. 3A and 3B are schematic illustrations of halves of a kinematic mounting system as may be incorporated into either of the analysis system of FIG. 1A and the image capture system of FIG. 2.
Figure 3A:
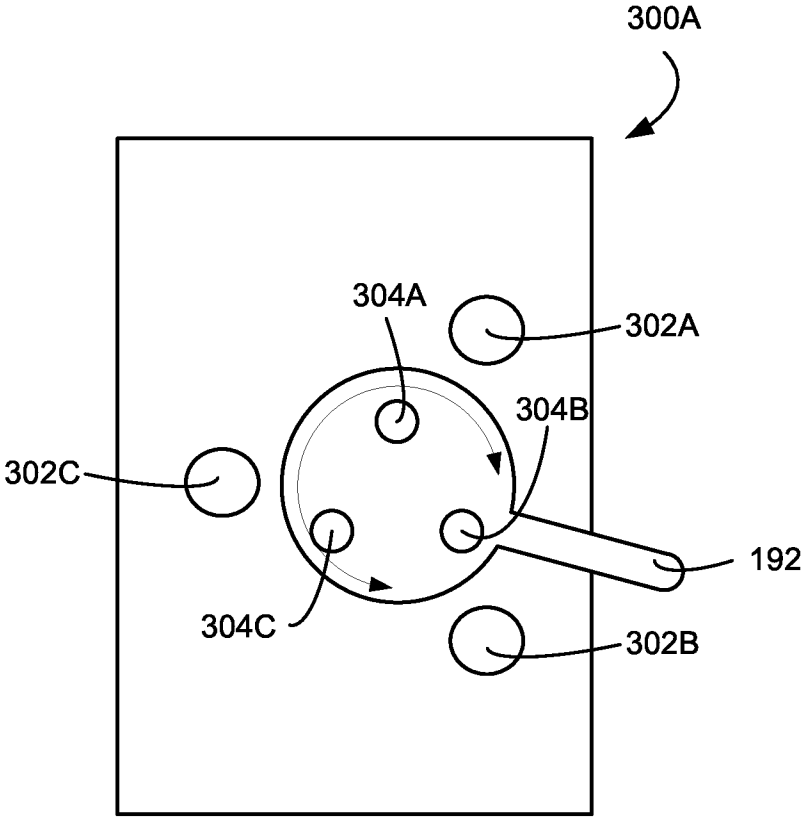

FIGS. 3A and 3B are schematic illustrations of an example kinematic mounting system 300 as may be used in implementations of the present disclosure. FIG. 3A illustrates a first half of the kinematic mounting system 300A that may generally correspond to an underside of the sample holder 182. FIG. 3B, on the other hand, illustrates a second half of the kinematic mounting system 300B and may generally correspond to the kinematic mounting surface 188 of the analysis system 100. It should be appreciated, however, that the second half of the kinematic mounting system 300B may also correspond to the kinematic mounting surface 206 of the image capture system 200 of FIG. 2.

Referring first to FIG. 3A, the first half of the kinematic mounting system 300A includes three spherical or hemispherical protrusions 302A-C distributed about the underside of the sample holder 182. As previously discussed, the sample holder 182 may also include a rotatable or otherwise movable latch mechanism 190. The latch 190 includes a first set of magnets 304A-C such that rotation of the latch 190 results in rotation of the magnets 304A-C.

Referring next to FIG. 3B, the second half of the kinematic mounting system 300B includes three channels 306A-C which, in the illustrated example, are defined by respective pairs of rods 308A-C. The second half of the kinematic mounting system 300B further includes a second set of magnets 310A-C arranged in a pattern similar to that of the first set of magnets 304A-C of the latch 190.

During operation, the first half of the kinematic mounting system 300A and the second half of the kinematic mounting system 300B may be coupled by placing the first half 300A onto the second half 300B such that the protrusions 302A-C of the first half 300A are received in the corresponding channels 306A-C of the second half 300B. When so disposed, the latch 190 may be manipulated (e.g., rotated) to align the first set of magnets 304A-C with the second set of magnets 310A-C, locking the two halves 300A, 300B together. To separate the kinematic mount, the latch 190 may be manipulated to misalign the first set of magnets 304A-C and the second set of magnets 310A-C, thereby unlocking the kinematic mount and allowing separation of the two halves of the kinematic mount.

It should be appreciated that the kinematic mount system illustrated in FIGS. 3A and 3B is merely one example of a kinematic mount suitable for use in applications of the present disclosure and other configurations are possible. For example, the components of the first half 300A, such as the protrusions 302A-C and the latch 190, may instead be disposed on the second half 300B, and vice versa. As previously noted, other styles of kinematic mechanisms may also be used. More generally, however, any suitable mounting system may be implemented in each of the analysis system 100 and the image capture system 200 that facilitates repeatable location of the sample 10 such that the detailed images captured by the analysis system 100 can be readily correlated and aligned with corresponding portions of the macro-level images captured by the image capture system 200.

Figure 4:
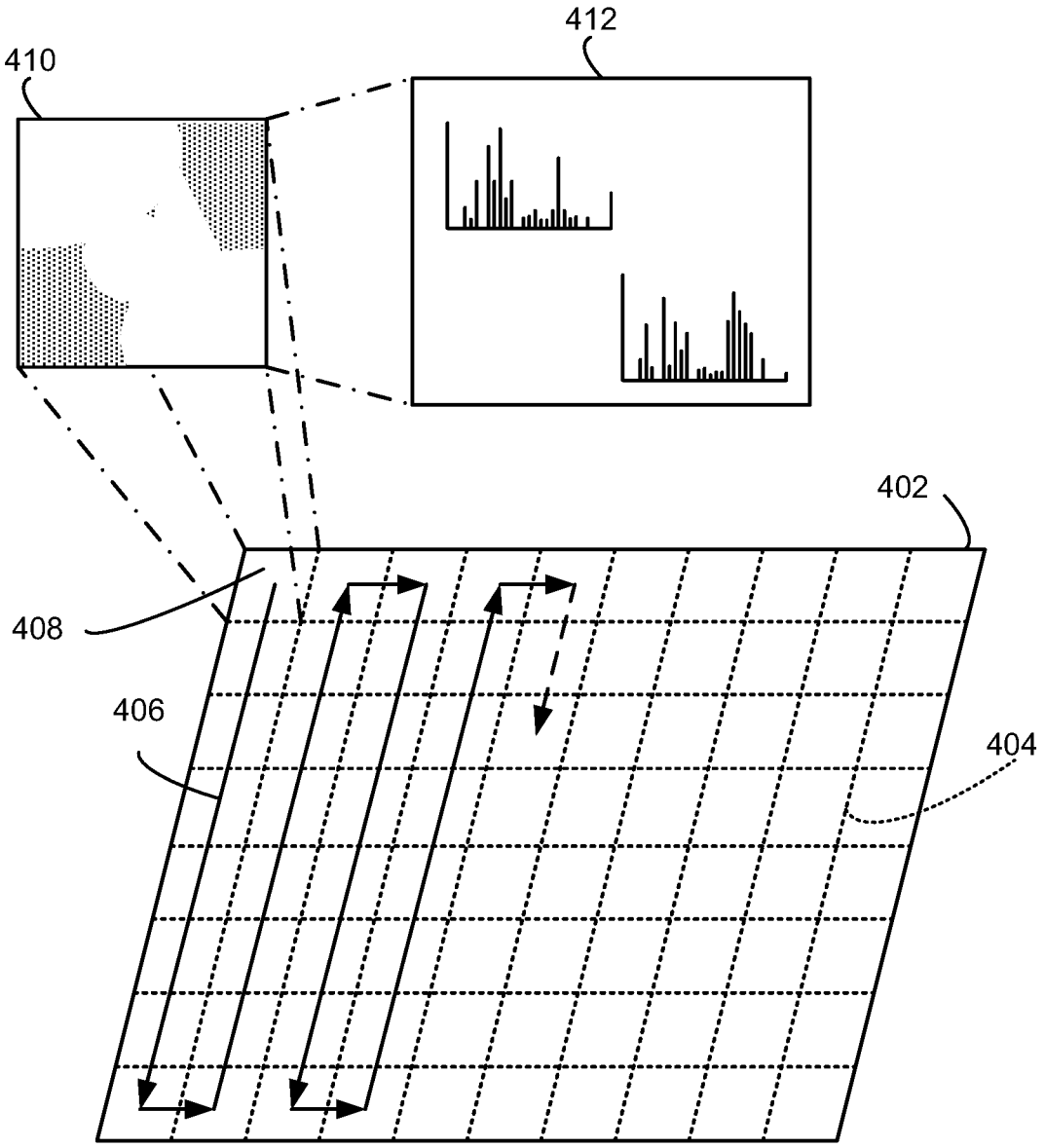
FIG. 4 is a graphical representation of the relationship between images and results data obtained during analysis of a sample, such as by using the system of FIG. 1A.

FIG. 4 is a graphical representation of the foregoing concepts and data storage approach. As previously noted, prior to inserting the sample 10 into the sample chamber 104 of the analysis system 100, a macro image 402 of the sample 10 may be captured using an image capture system, such as the image capture system 200 of FIG. 2. The macro image 402 may then be stored by the analysis system 100 (e.g., in a memory of the computing device 192).

As illustrated in FIG. 4, the macro image 402 may be subdivided by the analysis system 100 into a grid 404 or similar pattern, with each location in the grid representing an analysis location of the sample. The dimensions of each grid element may vary in different applications, however, in at least some implementations each element of the grid is on a similar order as the width of the D/A beam at the surface 12 of the sample 10. For example, as previously discussed, the D/A sub-system 120 may be configured to generate a focused beam having a diameter of no more than about 50 μm in diameter at the surface 12 of the sample 10. In such applications, the macro image 402 of the sample 10 may be sub-divided into a square grid in which each element is a square from and including about 50 μm by 50 μm to and including 100 μm to and including 100 μm.

During operation and prior to analysis, a user may be presented with the macro image 402 for identification of an analysis path/routine. For example, FIG. 4 includes a path 406 that extends through each grid element in a given column before moving to the subsequent column. This pattern may continue such that the path reaches each grid element of the macro image 402. It should be appreciated that the column by column approach illustrated in FIG. 4 is only an example and other analysis routines are contemplated. More generally, a user may select one or more specific locations or areas of the sample 10 for analysis. To the extent the user selects an area (which may correspond to any area up to and including the entire sample), the user may also select an analysis density or pattern. For example, the user may want in-depth analysis of a particular area of a sample and, as a result, may desire that an analysis be conducted at each discrete location (e.g., each grid element) within the area. Alternatively, if a more general analysis is desired, only a subset of grid elements may be identified for analysis (e.g., every second (or any other number) grid element within the area, every other (or any other number) row of elements within the area, every other (or any other number) column within the area). In still other implementations, a random sampling mode may be available in which random locations of all or a subset of the grid 404 is selected for analysis.

In at least certain implementations, the computing device 192 may be configured to automatically generate a path for analysis of the sample. In certain implementations, the analysis system may analyze the entire sample following a path similar to that of the path 406 of FIG. 4. In other implementations, the computing device 192 may be configured to identify particular areas of the sample 10 (e.g., areas having particular colors, shapes, or other notable characteristics) and target such areas of interest for more in-depth analysis (e.g., by automatically increasing the analysis density within the areas of interest).

Once an analysis routine has been identified, the analysis routine may be subsequently executed by the analysis system 100. In general, executing the analysis routine includes successively moving the sample 10 into locations to be analyzed and analyzing each location. As previously discussed, analyzing a given location may include capturing an image of the location and performing each of an organic material analysis and an inorganic material analysis. Following analysis at a location, the capture image (e.g., image 410) and analysis results (e.g., result data 412) may be linked to the grid element (e.g., grid element 408). This process may be repeated for each grid element identified for analysis within the analysis routine. Although illustrated in FIG. 4 as graphical data, it should be appreciated that the result data 412 may be stored as alphanumeric values, as a table of values, or any other suitable format and is not limited to graphical representations.

In light of the foregoing, implementations of the present disclosure may include storage of sample data in an efficient and easily navigable format. More specifically, each sample analyzed using the analysis system 100 may be represented by a macro level image including a relatively large portion of the sample surface. The macro-level image may be sub-divided into a grid or similar pattern and an underlying data structure (e.g., an array) may be linked to the macro-level image in which each element of the array represents a corresponding grid element. To the extent image data and/or mass spectroscopy data is subsequently obtained at a location of the sample, the corresponding array element may be populated with the image/mass spectroscopy data, links/pointers to such data, or similar information for retrieving the analysis data. Accordingly, the analysis data is stored in a manner that allows a user to easily view the sample as a whole (e.g., via the macro image) and select specific sample locations to obtain more detailed images and analysis data for the location. As previously mentioned, linking the analysis data and macro-level image enables the generation and display of various useful visualizations that may be overlaid on top of the macro-level image, such as heat or color maps, to facilitate further analysis by a user of the analysis system 100.

Analysis and Related Methods

FIGS. 5A-D illustrate a flow chart of an example method 500 of operating an analysis system in accordance with the present disclosure to analyze a sample containing organic and inorganic components. The method 500 may be implemented, for example, using the analysis system 100 illustrated in FIG. 1A-B. Accordingly, reference in the following discussion is made to the analysis system 100 and its components; however, it should be understood that the analysis system 100 should be regarded as a non-limiting example of a system that may implement the method 500.

Figure 5A:
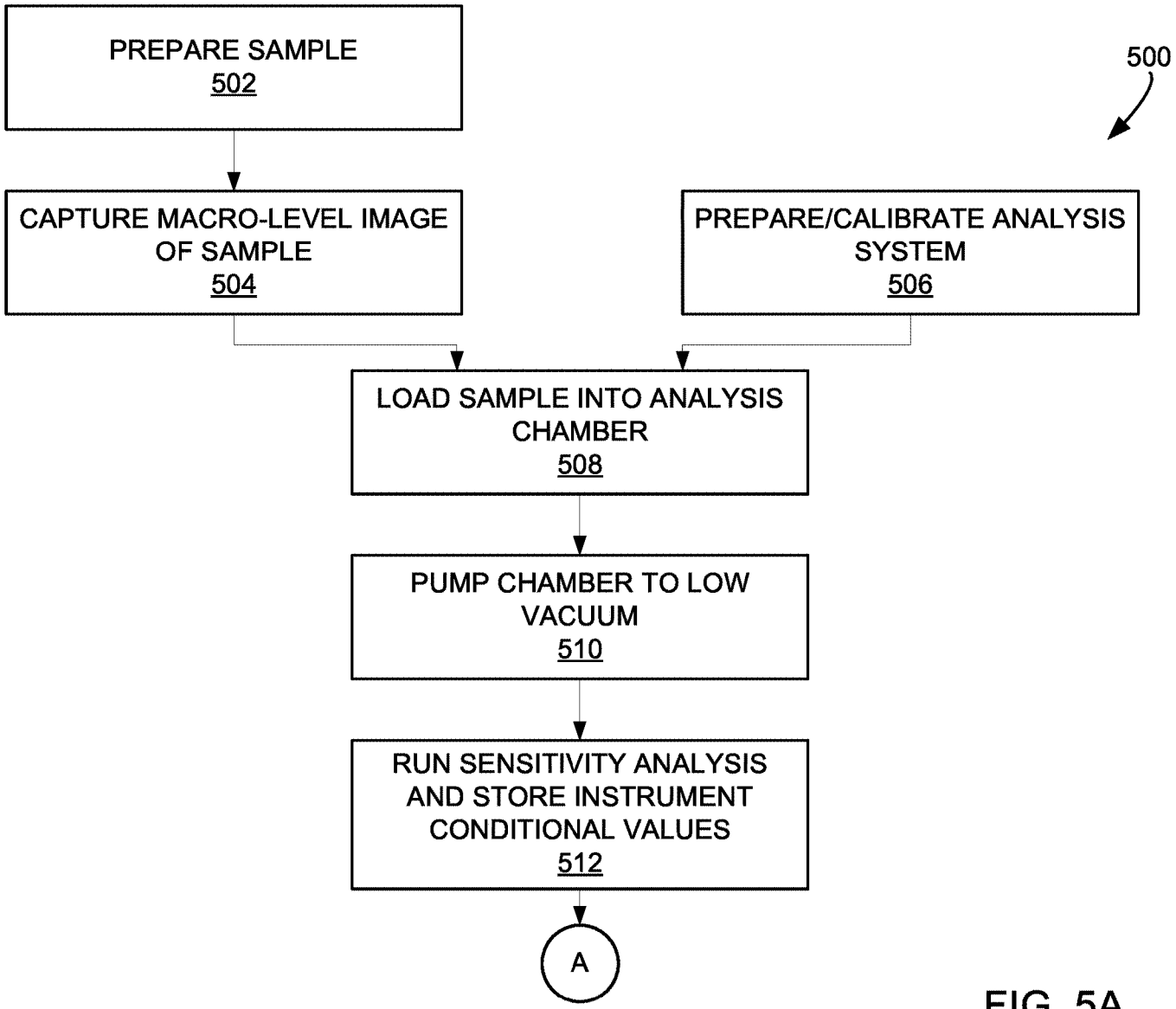
FIGS. 5A-D are a flow diagram for a method of analyzing a sample in accordance with the present disclosure. More specifically.

FIG. 5A generally illustrates the steps prior to actual analysis of the sample. Prior to analysis, each of the sample 10 and the analysis system 100 are each prepared for use. For example, at operations 502 and 504, the sample 10 is prepared and a macro-level image of the sample is capture and stored, respectively. Preparation of the sample 10 may include, among other things, cleaning, chemically treating, cutting, polishing, or otherwise preparing the sample surface 12. Preparation of the sample 10 may further include loading the sample onto a sample stage 184 or similar fixture for retaining the sample 10 during capture of the macro-level image and subsequent analysis. As previously discussed, capturing the macro-level image (operation 504) may include loading the sample 10 onto a kinematic or similar high-precision mount to facilitate later alignment of detailed images captured during analysis of the sample with the macro-level image.

Calibration of the analysis system 100 (operation 506) may include, among other things, performing various checks to confirm communication with and functionality of various sub-systems of the analysis system 100. Calibration may also include testing various components (e.g., confirming a full range of motion for the motors used to move the sample 10 within the sample chamber 104, activation of the various lasers and associated optical sub-systems, etc.). Calibration may also include configuring the mass spectrometer 102, such as by loading various matrix standards or similar information into the mass spectrometer 102 to configure the mass spectrometer 102 for analyzing particular types of samples. This may also include independent system parameters for organic and inorganic analysis. As illustrated in FIG. 5A calibration of the analysis system 100 and preparation of the sample 10 are generally independent steps and may be conducted in any order, including simultaneously (in whole or in part).

Once the sample 10 and analysis system 100 are prepared, the sample 10 is loaded into the vacuum chamber 106 (operation 508) and the vacuum chamber 106 is pumped to a low vacuum (operation 510). As sensitivity analysis may then be performed and corresponding instrument conditional values may be stored (operation 512). This may include executing a pre-loaded internal standard of a known matrix or an external standard loaded alongside the sample. Such values may be used to update the internal tables used in quantification.

With the sample 10 loaded into the analysis system 100, an analysis routine may be selected (operation 514). As previously discussed, doing so may include the user interacting with the computing device 192 to select one or more specific locations and/or areas for analysis (e.g., by clicking or otherwise identifying areas of interest on the macro-level image) and specifying to what extent each area is to be analyzed. Alternatively, the computing device 192 may be configured to automatically identify areas of interest of the sample and generate a corresponding analysis routine. With an analysis routine selected, analysis of the sample is initiated (operation 516).

Analysis of a given sample generally includes positioning the sample 10 such that the focal point of the D/A laser beam 16 and camera system 160 is at the first location specified in the analysis routine (operation 518). Analysis at that location then commences by first capturing a micro-level image of the location (operation 520). As previously discussed, the captured micro-level image may then be stored in a manner that links the image with the corresponding location of the macro-level image captured during operation 504.

Following capture of the micro-level image, the analysis system 100 initiates organic analysis at the current location (operation 522). As illustrated in FIG. 5C, organic analysis generally includes the steps of desorbing organic material using a low energy beam (operation 524), ionizing the resulting desorbed organic material to form an ionized vapor (operation 526), and analyzing the resulting ionized vapor (operation 528). As described in the context of FIG. 1A, the desorption process may include modifying an operational mode of a desorption/ablation (D/A) sub-system to generate a beam suitable for desorption of organic material from the sample 10. Generating a beam having suitable characteristics for desorption may include, among other things, using one or more filters, attenuators, mirrors, lenses, or other similar optical elements to manipulate a size, energy density, and wavelength of a beam generated by a D/A laser source 122 of the D/A sub-system 120 and directing the resulting beam to the current analysis location of the sample 10.

Figure 6:
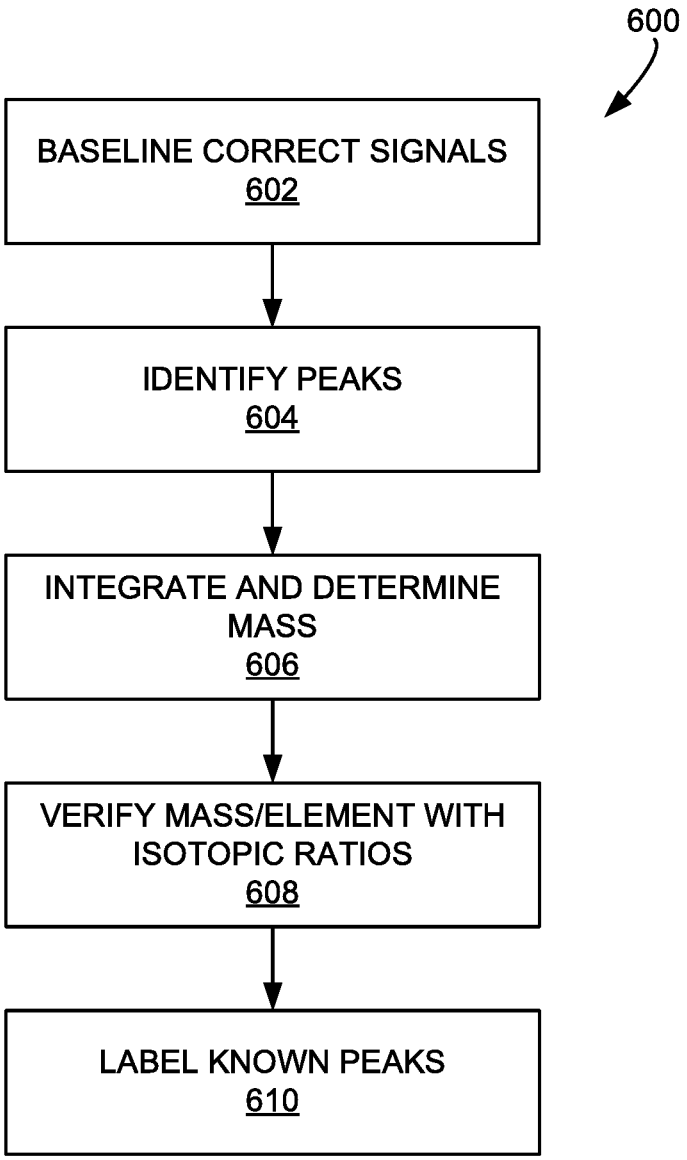
FIG. 6 is a flow chart illustrating a method for processing mass spectrometry data collected during analysis of organic or inorganic material obtained from a sample.

Desorption generally results in a vapor or similar cloud of organic material rising normal to the surface 12 of the sample 10. Accordingly, in certain implementations, the process of ionizing the desorbed organic material (operation 526) may include producing and directing an ionization beam 18 generated by an ionization sub-system 140 to a location normal to the sample surface 12. The resulting ionized vapor may subsequently be analyzed by the mass spectrometer 102 of the analysis system (operation 528). Doing so may include transporting the ionized vapor, such as by use of the quadrupole ion guide 112 or similar delivery system, including the opening of any valves (e.g., gate valve 170) to allow transportation of the ionized vapor from the vacuum chamber 106 to the mass spectrometer 102. One example of an analysis process is illustrated in FIG. 6 and is discussed below in further detail. Analysis of the sample at operation 528 may further include storing the results of the analysis. Similar to the micro-level image, such storage may include storing the organic analysis result data in a manner that is linked with the corresponding location of the macro-level image captured during operation 504.

Figure 5B:
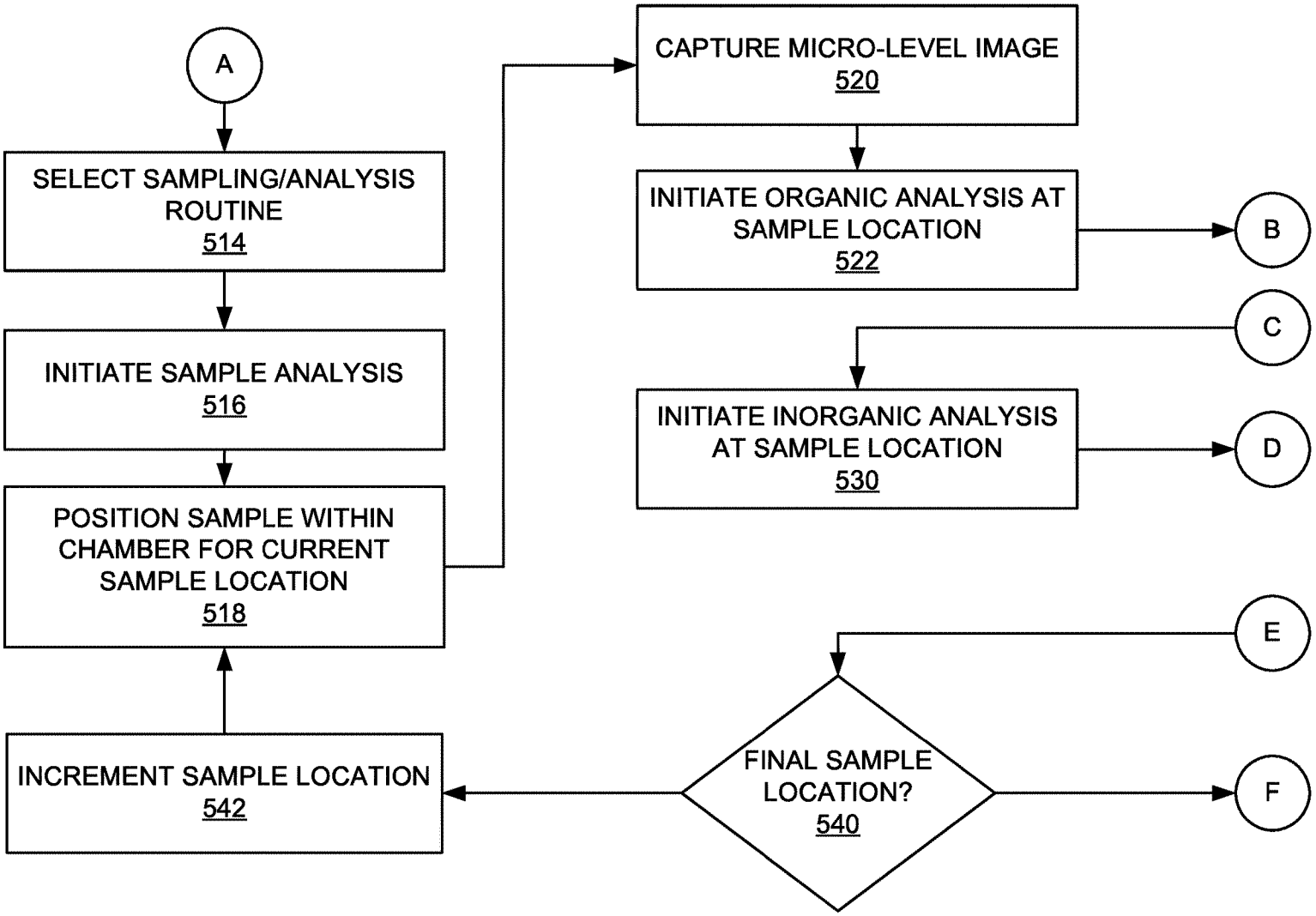
Figure 5C:
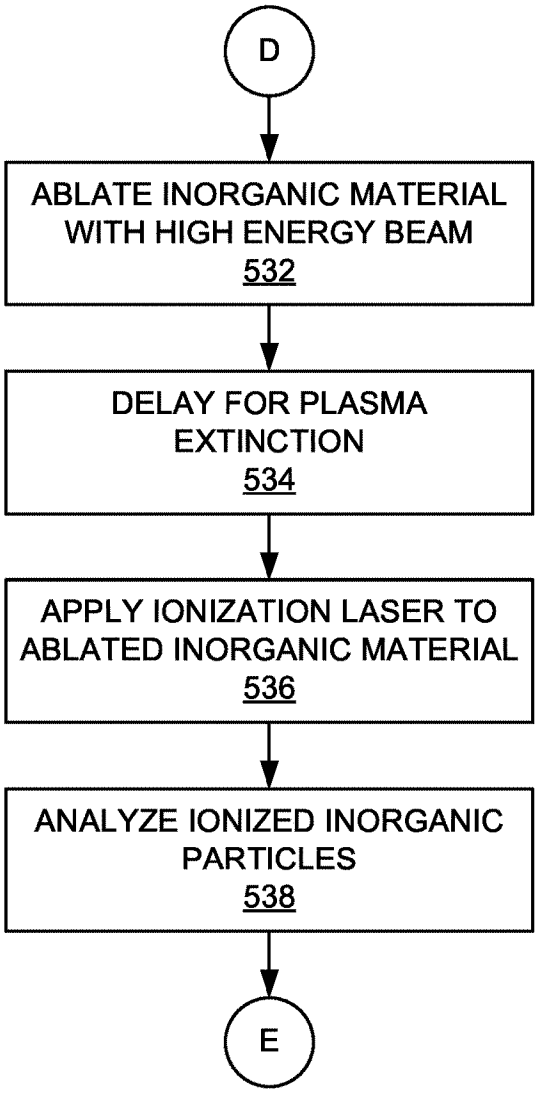
Figure 5C:
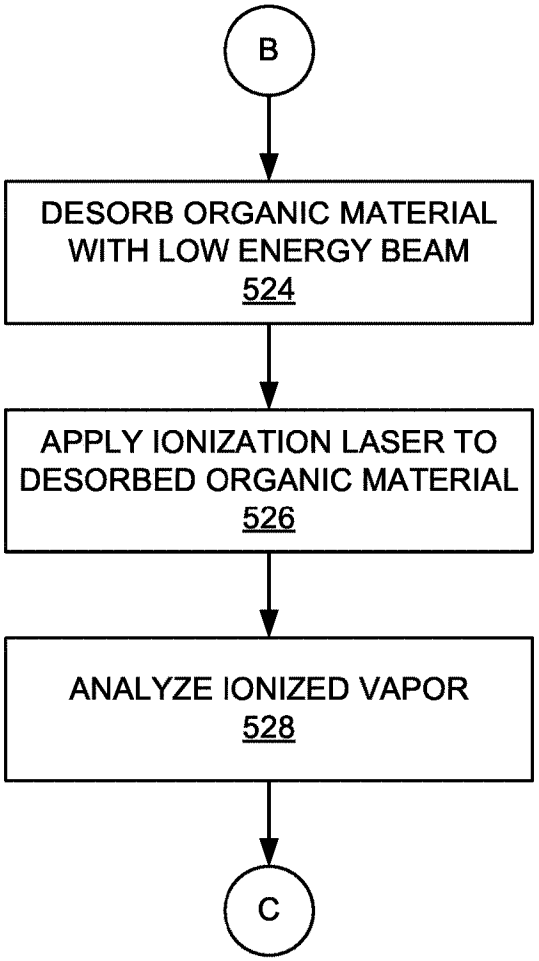
Figure 5D:
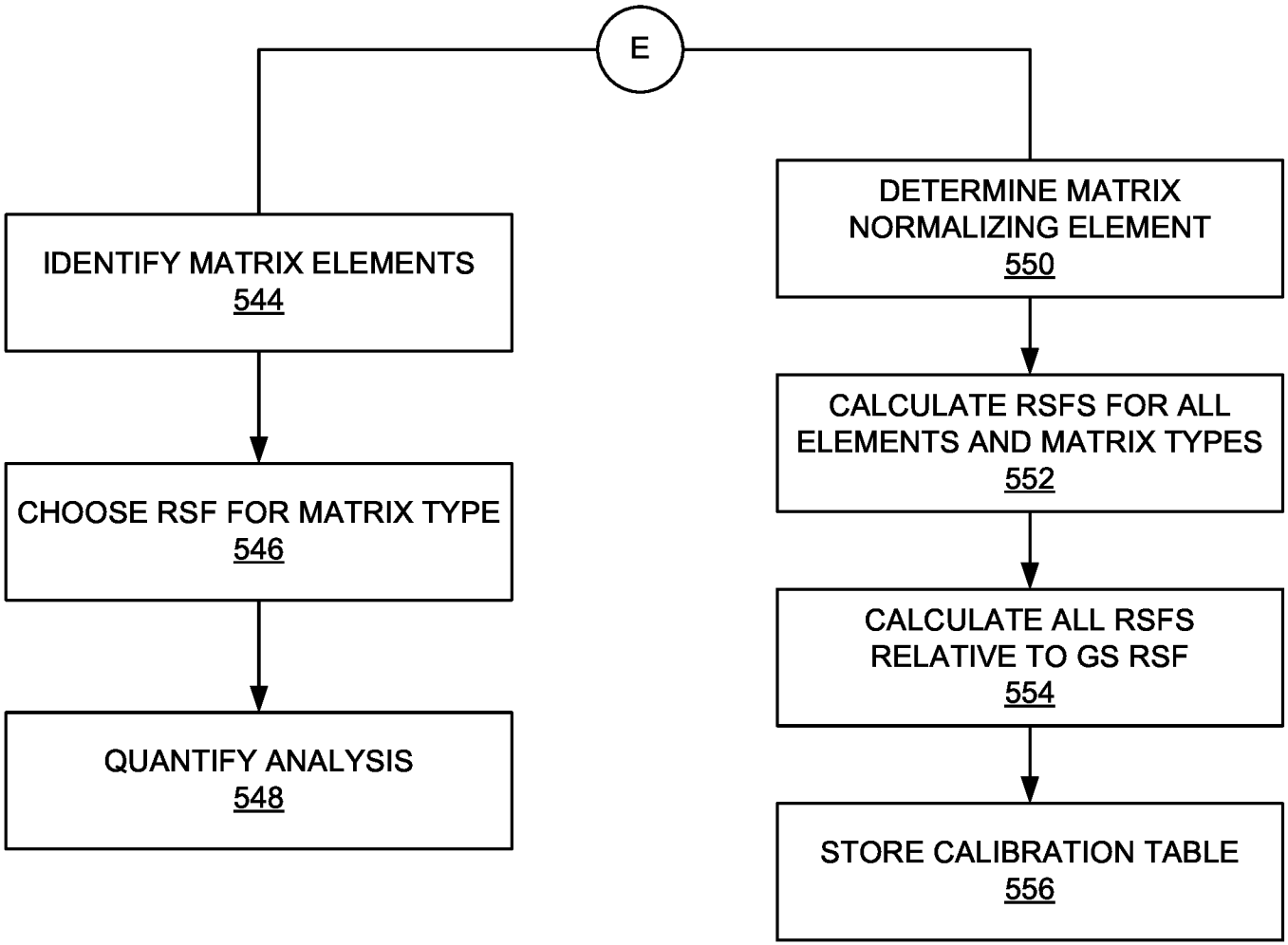

Following the completion of organic analysis, the analysis system 100 initiates inorganic analysis at the current sample location (operation 530, shown in FIG. 5B). As illustrated in FIG. 5C, inorganic analysis generally includes the steps of ablating inorganic material using a high energy beam (operation 532), imposing a delay to allow for extinction of any plasma resulting from the ionization process (operation 534), ionizing the resulting particle cloud of inorganic material to form an ionized particle cloud (operation 536), and analyzing the resulting ionized particle cloud (operation 538). Similar to the desorption process, the ablation process may include modifying an operational mode of the desorption/ablation (D/A) sub-system to generate a beam suitable for ablating inorganic material from the sample 10. Generating such a beam may include, among other things, using one or more filters, attenuators, mirrors, lenses, or other similar optical elements to manipulate a size, energy density, and wavelength of the beam generated by the D/A laser source 122 of the D/A sub-system 120 and directing the resulting beam to the current analysis location of the sample 10.

Ablation generally results in a cloud of inorganic particles material rising normal to the surface 12 of the sample 10. In certain cases, the energy used to ablate the inorganic material may generate charged plasma that may negatively impact subsequent ionization and analysis of the inorganic material. Accordingly, as noted above, the analysis system 100 may be configured to apply a delay between ablation and ionization (operation 534). The duration of the delay may vary, however, in at least certain implementations, the delay may be from and including about 10 ns to and including about 1 μs.

Following the delay, the resulting particle cloud of inorganic matter is ionized (operation 526). Similar to ionization of the vapor cloud in operation 526, ionization of the particle cloud may include producing and directing the ionization beam 18 generated by the ionization sub-system 140 to a location normal to the sample surface 12. The resulting ionized particles may then be directed to and analyzed by the mass spectrometer 102 of the analysis system (operation 538). Analysis of the sample at operation 538 may further include storing the results of the inorganic analysis. Similar to the micro-level image and the organic analysis data, such storage may include storing the inorganic analysis result data in a manner that is linked with the corresponding location of the macro-level image captured during operation 504.

Following execution of the inorganic analysis, the analysis system determines whether the current sample location is the final sample location as dictated by the analysis routine (operation 540). If not, the sample location is incremented (operation 542) to the next sample location of the analysis routine and the process of positioning the sample, capturing an image of the sample, and performing each of an organic and inorganic analysis (operations 518-538) are repeated at the new location.

If, on the other hand, data for the final location of the analysis routine is captured, final processing of the collected data may occur. Although analysis of the collected data may vary, in at least one implementation of the present disclosure, analyzing the collected data may include each of identifying matrix elements (operation 544), choosing a suitable relative sensitivity factor (RSF) for the matrix type (operation 546), and applying each of the identified matrix and corresponding RSF to quantify the analysis (operation 548). This allows for a true quantification of a sample which may have many matrices within a small area. Each grid is analyzed first for matrix compositions which then determines the factors used for ultimate quantification In addition to quantifying the analysis, the collected data may also be used to provide feedback to the analysis system 100 and/or to update or otherwise modify calibration data of the analysis system 100. For example and without limitation, in at least one implementation, following analysis of a sample a matrix normalizing element may be identified (operation 550). Moreover, each of RSFs for all elements and matrix types may also be calculated and RSFs relative to a general standard RSF may also be calculated (operations 552, 554, respectively). Finally, the foregoing information may be stored in a calibration table (operation 556) for later use in calibrating the analysis system 100 prior to analysis of subsequent samples.

While the foregoing description of the method 500 includes analysis of both organic and inorganic material at each sample location, it should be appreciated that in other implementations the system may be configured to analyze only organic material or only inorganic material at any or all sample locations.

As previously noted, FIG. 6 is a flow chart illustrating a method 600 of analyzing ionized particles, such as may be used by the mass spectrometer 102 of the analysis system 100 in conjunction with the computing device 192. The method 600 illustrated in FIG. 6 may generally be applied to analysis of either the ionized vapor cloud produced during analysis of organic material or the ionized particle cloud produced during analysis of inorganic material.

At operation 602, a baseline correction may be applied to the signals received during the analysis process. The corrected signals are then analyzed to identify peaks (operation 604) in the mass spectrum results. Such peaks generally correspond to relatively high quantities of detected particles having particular mass-to-charge ratios. The resulting peak data is then integrated or otherwise processed to determine the mass of the particles associated with each peak (operation 606). The masses and elements may then be verified using isotropic ratios (operation 608). Following verification, the peaks may be labelled or otherwise tagged with the particular element or compound represented by the peak (operation 610).

It should be appreciated that the unique configuration of the analysis system 100 enables a single standard to be used for multi-matrix quantification. As a result, the strict sample-standard matching practices required for many conventional instruments and which are highly susceptible to matrix effects can be avoided. For example, in implementations of the current disclosure, the initial neutral particle cloud formed during ablation is not affected to a substantial degree by the ablation process and the effect of the changing chemical environment (i.e., the matrix) is orders of magnitude less than ions which are produced by the resultant plasma. Thus, by having a more regular particle cloud which ionized particles may be produced, the resulting ionized particles can be more readily characterized and quantified. It should be noted that all variances in matrix effects may be normalized and thus the matrix characterization may be used to determine the relative RSFs (MEM) as discussed below in further detail.

In at least certain implementations, the quantification process may require an initial calibration stage in which standards of varying matrix types are analyzed (e.g., the calibration operation 506 of FIG. 5A). Such calibration may include selecting one or more general standards (e.g., silicate glass), analyzing the selected standards, and calculating individual relative sensitivity factors (RSFs) for the standards. A matrix-effect-multiplier (MEM) may then be computed for each matrix type based on the foregoing calculations. The MEM generally functions as a scaling factor for each element's effects in different matrices relative to the general standard matrix. Accordingly, by calculating an MEM for a given sample, the sample may be rapidly quantified despite the sample possibly including multiple matrices in a small area. The foregoing approach is only possible because of the neutral particle production normalization and the fact the instrument is in a static environment with no gas-flows or changes in atmospheric conditions. Such static conditions allow for more regular behavior and operation as compared to conventional analysis systems. It should also be noted that the operational behavior of systems according to the present disclosure also allows the system to be characterized and standardized less often than other techniques and can also lead to the development of standardless quantification.

During quantification, a relative sensitivity factors (RSF) is generally used to scale measured peak areas obtained during spectrometry such that variations in the peak areas are representative of the amount of material in the sample. In other words, the RSF is applied to convert the measured ion intensities obtained during spectrometry into atomic concentrations in the investigated matrix. Each element within a sampled matrix may behave differently in a particular spectrometry system. As a result, a respective RSF is generally required for each element within a sample being quantified.

RSFs often depend on characteristics of the sample being analyzed but also on the conditions under which such analysis occurs. Accordingly, while libraries of RSFs may be available for certain spectrometry systems, the relative utility of such RSFs are highly dependent on subsequent analysis conditions being substantially the same as when the RSFs were determined. To the extent analysis is conducted under disparate conditions (e.g., different environmental conditions or different instrument conditions such as resulting from instrument drift), previously determined RSF values may be unreliable or otherwise inaccurate.

To address the foregoing issue, implementations of systems according to the present disclosure may calculate effective RSF ($RSF_{Eff}$) values that more readily take into account variability in the analysis system as compared to simply relying on libraries of stored RSF values. In one implementation, effective RSFs are calculated for each element of interest based on each of a dynamically updated general standard RSF and a library of matrix standard RSFs. The general standard RSF corresponds to a known material for which a test sample is available and for which the actual contents/quantification of molecular species within the test sample are known. In one example, the general standard RSF may correspond to a standard form of glass (e.g., a standardized piece of borosilicate glass) with a known and certified composition. The matrix standard RSFs, on the other hand, are RSF values associated with particular matrices and characterize the relative sensitivity attributable to matrix effects for those matrices. In the context of sample analysis for oil and gas, for example, various matrix standard RSFs for commonly encountered minerals/matrices (e.g., plagioclase, alkali feldspar, pyroxene, quartz, mica, etc.) may be provided to the analysis system, each matrix standard RSF providing relative sensitivity values arising out of the matrix effects for the particular mineral/matrix. In certain implementations of the present disclosure, initial general standard RSFs and the matrix standard RSFs may be combined to generate what are referred to herein as matrix effect multipliers (MEMs) for various elements of interest.

As conditions associated with the analysis system change, the test sample corresponding to the general standard RSFs may be periodically analyzed to obtain updated general standard RSFs. The updated general standard RSFs may then be scaled using the corresponding MEMs to determine the effective RSF.

Over time or as environmental or other conditions change, the sample material may be reanalyzed by the system to obtain an updated general standard RSF which in turn may be used to calculate updated effective RSFs.

As noted, the foregoing process includes calculating an effective relative sensitivity factor for an element in question (e). In one specific implementation, the effective relative sensitivity factor can be calculated according to the following equation (1):

$$RSF_{Eff}=MEM^{e}(RSF_{G}^{e}) \tag{1}$$

where $RSF_{Eff}$ is the effective relative sensitivity factor, MEM is a matrix effect multiplier, $RSF_G$ is a relative sensitivity factor according to a general standard, and e is the element in question.

The matrix effect multiplier (MEM) for the element e may in turn be calculated according to equation (2):

$$MEM^{e} = \frac{RSF_{M}^{e}}{RSF_{G}^{e}} \tag{2}$$

where $RSF_M$ is a relative sensitivity factor according to a matrix effect standard for element e.

The relative sensitivity factor according to the general standard ($RSF_G$) may in turn be calculated according to equation (3):

$$RSF_{G}^{e} = \left[\frac{\left(\frac{X_{G}^{e}}{X_{G}^{N_G}}\right)}{\left(\frac{P_{G}^{e}}{P_{G}^{N_G}}\right)}\right] \tag{3}$$

where $X_G$ is concentration according to the general standard and $P_G$ is an integrated peak according to the general standard. Each of XG and $P_G$ are further included in terms of the element in question (e) and a normalizing element relative to the general standard ($N_G$).

Similarly, the relative sensitivity factors according to the matrix effect standard ($RSF_M$) may in turn be calculated according to equation (4):

$$RSF_{M}^{e} = \left[\frac{\left(\frac{X_{M}^{e}}{X_{M}^{N_M}}\right)}{\left(\frac{P_{M}^{e}}{P_{M}^{N_M}}\right)}\right] \tag{4}$$

where $X_M$ is concentration according to the matrix effect standard and $P_M$ is an integrated peak according to the matrix effect standard. Each of $X_M$ and $P_M$ are further included in terms of the element in question (e) and a normalizing element relative to the matrix effect standard ($N_M$).

Figure 7:
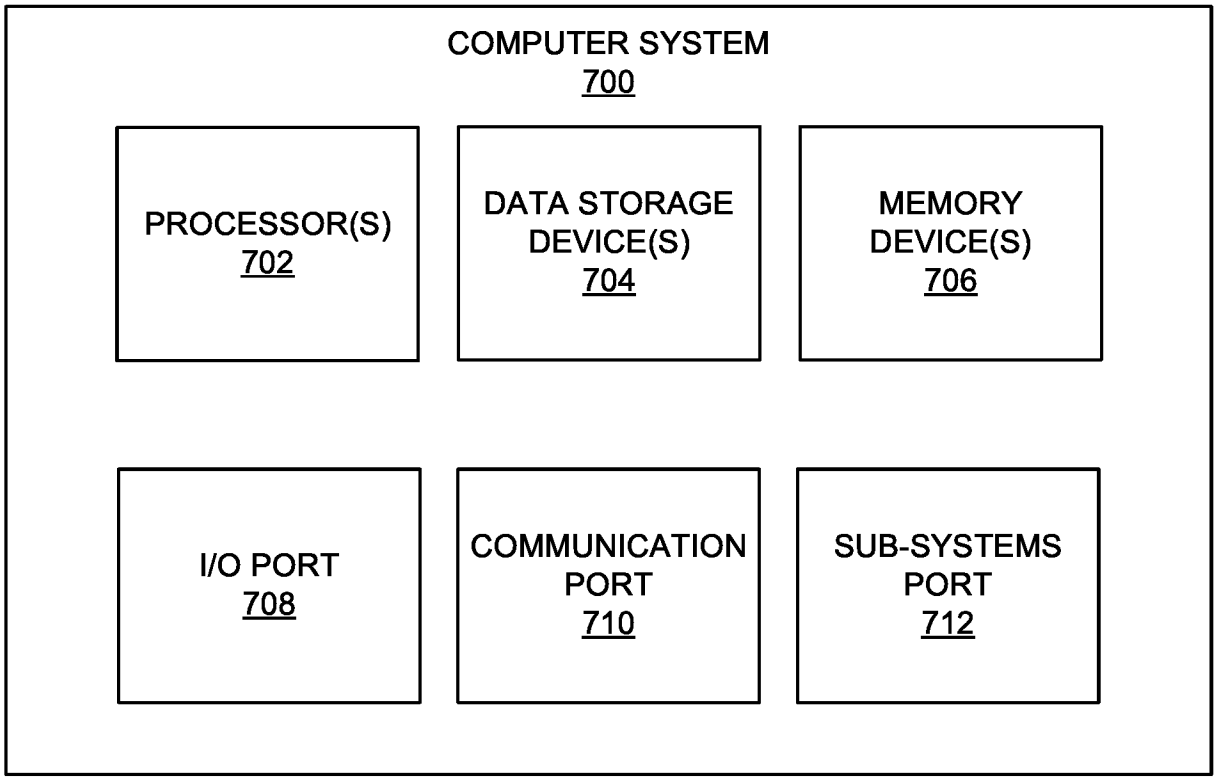
FIG. 7 is a block diagram illustrating a computer system as may be included in the analysis system of FIG. 1A.

Referring to FIG. 7, a schematic illustration of an example computing system 700 having one or more computing units that may implement various systems, processes, and methods discussed herein is provided. For example, the example computing system 700 may correspond to, among other things, the computing device 192 of the analysis system 100 of FIG. 1A. It will be appreciated that specific implementations of these devices may be of differing possible specific computing architectures not all of which are specifically discussed herein but will be understood by those of ordinary skill in the art.

The computer system 700 may be a computing system capable of executing a computer program product to execute a computer process. Data and program files may be input to computer system 700, which reads the files and executes the programs therein. Some of the elements of the computer system 700 are shown in FIG. 7, including one or more hardware processors 702, one or more data storage devices 704, one or more memory devices 708, and/or one or more ports 708-712. Additionally, other elements that will be recognized by those skilled in the art may be included in the computing system 700 but are not explicitly depicted in FIG. 7 or discussed further herein. Various elements of the computer system 700 may communicate with one another by way of one or more communication buses, point-to-point communication paths, or other communication means not explicitly depicted in FIG. 7.

The processor 702 may include, for example, a central processing unit (CPU), a microprocessor, a microcontroller, a digital signal processor (DSP), and/or one or more internal levels of cache. There may be one or more processors 702, such that the processor 702 comprises a single central-processing unit, or a plurality of processing units capable of executing instructions and performing operations in parallel with each other, commonly referred to as a parallel processing environment.

The computer system 700 may be a conventional computer, a distributed computer, or any other type of computer, such as one or more external computers made available via a cloud computing architecture. The presently described technology is optionally implemented in software stored on data storage device(s) 704, stored on memory device(s) 706, and/or communicated via one or more of the ports 708-712, thereby transforming the computer system 700 in FIG. 7 to a special purpose machine for implementing the operations described herein. Examples of the computer system 700 include personal computers, terminals, workstations, mobile phones, tablets, laptops, personal computers, multimedia consoles, gaming consoles, set top boxes, and the like.

One or more data storage devices 704 may include any non-volatile data storage device capable of storing data generated or employed within the computing system 700, such as computer executable instructions for performing a computer process, which may include instructions of both application programs and an operating system (OS) that manages the various components of the computing system 700. Data storage devices 704 may include, without limitation, magnetic disk drives, optical disk drives, solid state drives (SSDs), flash drives, and the like. Data storage devices 704 may include removable data storage media, non-removable data storage media, and/or external storage devices made available via wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. One or more memory devices 706 may include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology may reside in the data storage devices 704 and/or the memory devices 706, which may be referred to as machine-readable media. It will be appreciated that machine-readable media may include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media may include a single medium or multiple media (e.g., a centralized or distributed database, and/or associated caches and servers) that store the one or more executable instructions or data structures.

In some implementations, the computer system 700 includes one or more ports, such as an input/output (I/O) port 708, a communication port 710, and a sub-systems port 712, for communicating with other computing, network, or similar devices. It will be appreciated that the ports 708-712 may be combined or separate and that more or fewer ports may be included in the computer system 700.

The I/O port 708 may be connected to an I/O device, or other device, by which information is input to or output from the computing system 700. Such I/O devices may include, without limitation, one or more input devices, output devices, and/or environment transducer devices.

In one implementation, the input devices convert a human-generated signal, such as, human voice, physical movement, physical touch or pressure, and/or the like, into electrical signals as input data into the computing system 700 via the I/O port 708. Similarly, the output devices may convert electrical signals received from the computing system 700 via the I/O port 708 into signals that may be sensed as output by a human, such as sound, light, and/or touch. The input device may be an alphanumeric input device, including alphanumeric and other keys for communicating information and/or command selections to the processor 702 via the I/O port 708. The input device may be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices may include, without limitation, a display, a touchscreen, a speaker, a tactile and/or haptic output device, and/or the like. In some implementations, the input device and the output device may be the same device, for example, in the case of a touchscreen.

The environment transducer devices convert one form of energy or signal into another for input into or output from the computing system 700 via the I/O port 708. For example, an electrical signal generated within the computing system 700 may be converted to another type of signal, and/or vice-versa. In one implementation, the environment transducer devices sense characteristics or aspects of an environment local to or remote from the computing device 700, such as, light, sound, temperature, pressure, magnetic field, electric field, chemical properties, physical movement, orientation, acceleration, gravity, and/or the like. Further, the environment transducer devices may generate signals to impose some effect on the environment either local to or remote from the example the computing device 700, such as, physical movement of some object (e.g., a mechanical actuator), heating, or cooling of a substance, adding a chemical substance, and/or the like.

In one implementation, a communication port 710 is connected to a network by way of which the computer system 700 may receive network data useful in executing the methods and systems set out herein as well as transmitting information and network configuration changes determined thereby. Stated differently, the communication port 710 connects the computer system 700 to one or more communication interface devices configured to transmit and/or receive information between the computing system 700 and other devices by way of one or more wired or wireless communication networks or connections. Examples of such networks or connections include, without limitation, Universal Serial Bus (USB), Ethernet, WiFi, Bluetooth®, Near Field Communication (NFC), Long-Term Evolution (LTE), and so on. One or more such communication interface devices may be utilized via communication port 710 to communicate one or more other machines, either directly over a point-to-point communication path, over a wide area network (WAN) (e.g., the Internet), over a local area network (LAN), over a cellular (e.g., third generation (3G) or fourth generation (4G)) network, or over another communication means. Further, the communication port 710 may communicate with an antenna for electromagnetic signal transmission and/or reception.

The computer system 700 may include a sub-systems port 712 for communicating with one or more sub-systems, to control an operation of the one or more sub-systems, and to exchange information between the computer system 700 and the one or more sub-systems. Examples of such sub-systems include, without limitation, imaging systems, radar, LIDAR, motor controllers and systems, battery controllers, fuel cell or other energy storage systems or controls, light systems, navigation systems, environment controls, entertainment systems, and the like.

The system set forth in FIG. 7 is but one possible example of a computer system that may employ or be configured in accordance with aspects of the present disclosure. It will be appreciated that other non-transitory tangible computer-readable storage media storing computer-executable instructions for implementing the presently disclosed technology on a computing system may be utilized.

Although various representative embodiments have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A method of sample analysis comprising:

applying a first beam in the infrared range to a sample to desorb organic material from a location of the sample, the first beam originating from a first laser source and directed onto the sample at an angle of incidence;

applying a first ionization beam to the desorbed organic material to ionize the desorbed organic material, the first ionization beam originating from a second laser source different than the first laser source;

delivering the ionized organic material to a mass spectrometer for analysis;

without repositioning the sample relative to the first laser source, applying a second beam in the ultraviolet range to the sample to ablate inorganic material from the location of the sample, the second beam directed onto the sample at the angle of incidence and generated by modifying a beam originating from the first laser source, wherein modifying the beam comprises filtering the beam;

applying a second ionization beam to the ablated inorganic material to generate ionized inorganic material, the second ionization beam originating from the second laser source; and delivering the ionized inorganic material to the mass spectrometer for analysis.

2. The method of claim 1, wherein the first beam has a first wavelength that is a fundamental wavelength of the first laser source and the second beam has a second wavelength less than the fundamental wavelength of the first laser source.

3. The method of claim 2, wherein modifying the beam to generate the second beam further comprises focusing the beam.

4. The method of claim 1, wherein the first beam has a wavelength of approximately 1064 nm.

5. The method of claim 1, wherein the second beam has a wavelength of approximately 266 nm.

6. The method of claim 1, wherein each of the first beam and the second beam each have a beam width of 50 μm or less at the location of the sample.

7. The method of claim 1, wherein the first beam has an energy density of at least 10 $MW/cm^2$ at the location of the sample.

8. The method of claim 1, wherein the second beam has an energy density of at least about 1 $GW/cm^2$ at the location of the sample.

9. The method of claim 1, wherein ablating the sample generates a plasma cloud, the method further comprising waiting between ablating the sample and ionizing the ablated inorganic material such that the plasma cloud extinguishes.

10. The method of claim 1 further comprising, prior to applying the first beam, capturing an image of the location of the sample.

* * * * *